US010421028B2

(12) United States Patent
Choi

(10) Patent No.: US 10,421,028 B2
(45) **Date of Patent: *Sep. 24, 2019**

(54) TRANSFORMABLE TOY

(71) Applicant: CHOIROCK CONTENTS FACTORY CO., LTD., Seoul (KR)

(72) Inventor: Jong-Ill Choi, Seoul (KR)

(73) Assignee: CHOIROCK CONTENTS FACTORY CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/573,409

(22) PCT Filed: May 12, 2015

(86) PCT No.: PCT/KR2015/004711

§ 371 (c)(1),
(2) Date: Nov. 10, 2017

(87) PCT Pub. No.: WO2016/182096

PCT Pub. Date: Nov. 17, 2016

(65) Prior Publication Data

US 2018/0133612 A1 May 17, 2018

(51) Int. Cl.

| | |
|---|---|
| ***A63H 33/00*** | (2006.01) |
| ***A63H 9/00*** | (2006.01) |
| ***A63H 17/02*** | (2006.01) |
| ***A63H 17/26*** | (2006.01) |

(52) U.S. Cl.

CPC ..... *A63H 33/003* (2013.01); *A63H 9/00* (2013.01); *A63H 17/02* (2013.01); *A63H 17/264* (2013.01)

(58) Field of Classification Search

CPC ..... A63H 33/003; A63H 9/00; A63H 17/02; A63H 17/264

USPC ..... 446/273, 276, 282, 284, 285, 295, 298, 446/300, 309, 310, 313, 339, 340, 354, 446/376, 377, 378

See application file for complete search history.

(56) References Cited

U.S. PATENT DOCUMENTS

| | | | | |
|---|---|---|---|---|
| 3,572,715 A * | 3/1971 | Ramirez | ..... | A63H 13/16 124/16 |
| 3,688,435 A * | 9/1972 | Sapkus | ..... | A63H 13/02 446/310 |
| 4,466,214 A | 8/1984 | Kulesza et al. | | |
| 4,654,018 A * | 3/1987 | Farrington | ..... | A63H 27/14 446/308 |

(Continued)

FOREIGN PATENT DOCUMENTS

| | | |
|---|---|---|
| JP | 2001-17751 A | 1/2001 |
| KR | 10-1999-0065295 A | 8/1999 |

(Continued)

OTHER PUBLICATIONS

International Search Report dated May 12, 2015 in corresponding International Patent Application No. PCT/KR2015/004711 (2 pages in English; 3 pages in Korean).

*Primary Examiner* — Vishu K Mendiratta
(74) *Attorney, Agent, or Firm* — NSIP Law

(57) ABSTRACT

The present invention provides a transforming toy which enables a toy in a first form to transform into a second form by means of a random lock releasing means and thus discharge an item which is inherently provided, and enables easy restoration from the transformed second form into the first form.

21 Claims, 24 Drawing Sheets

(56) References Cited

U.S. PATENT DOCUMENTS

| | | | | |
|---|---|---|---|---|
| 6,086,446 | A * | 7/2000 | Arriola | A63H 33/003 446/308 |
| 2005/0093259 | A1* | 5/2005 | Williams | B62B 9/20 280/47.38 |
| 2007/0197124 | A1* | 8/2007 | Sato | A63H 33/003 446/129 |

FOREIGN PATENT DOCUMENTS

| | | | |
|---|---|---|---|
| KR | 10-1327306 | B1 | 11/2013 |
| KR | 10-1370617 | B1 | 3/2014 |

* cited by examiner

【FIG. 1】
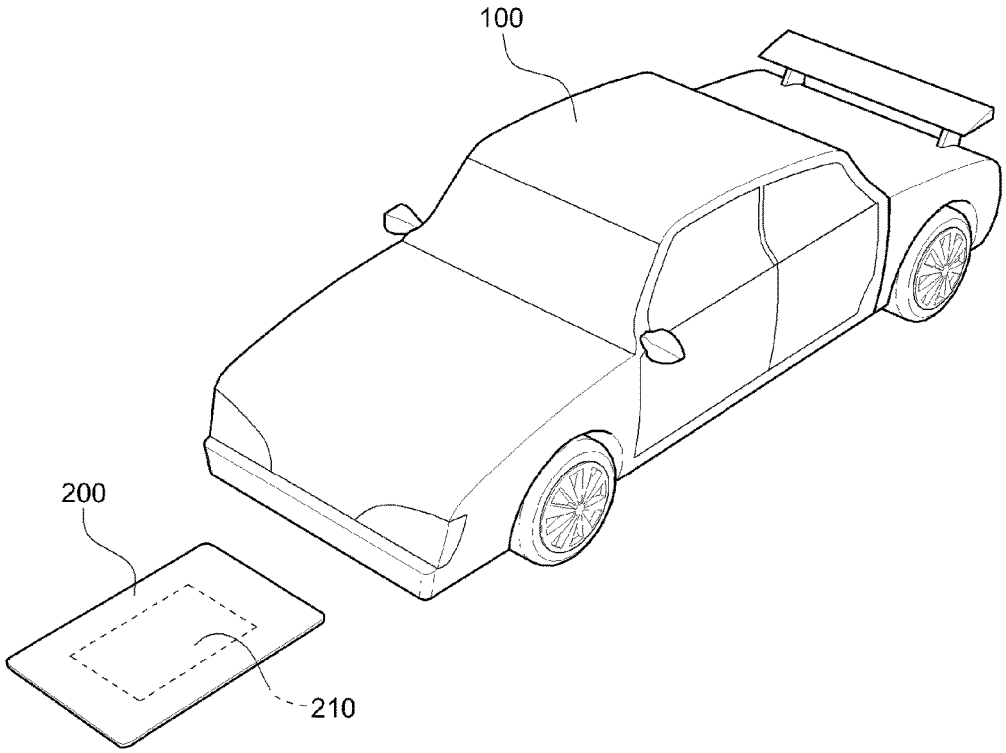

【FIG. 2】
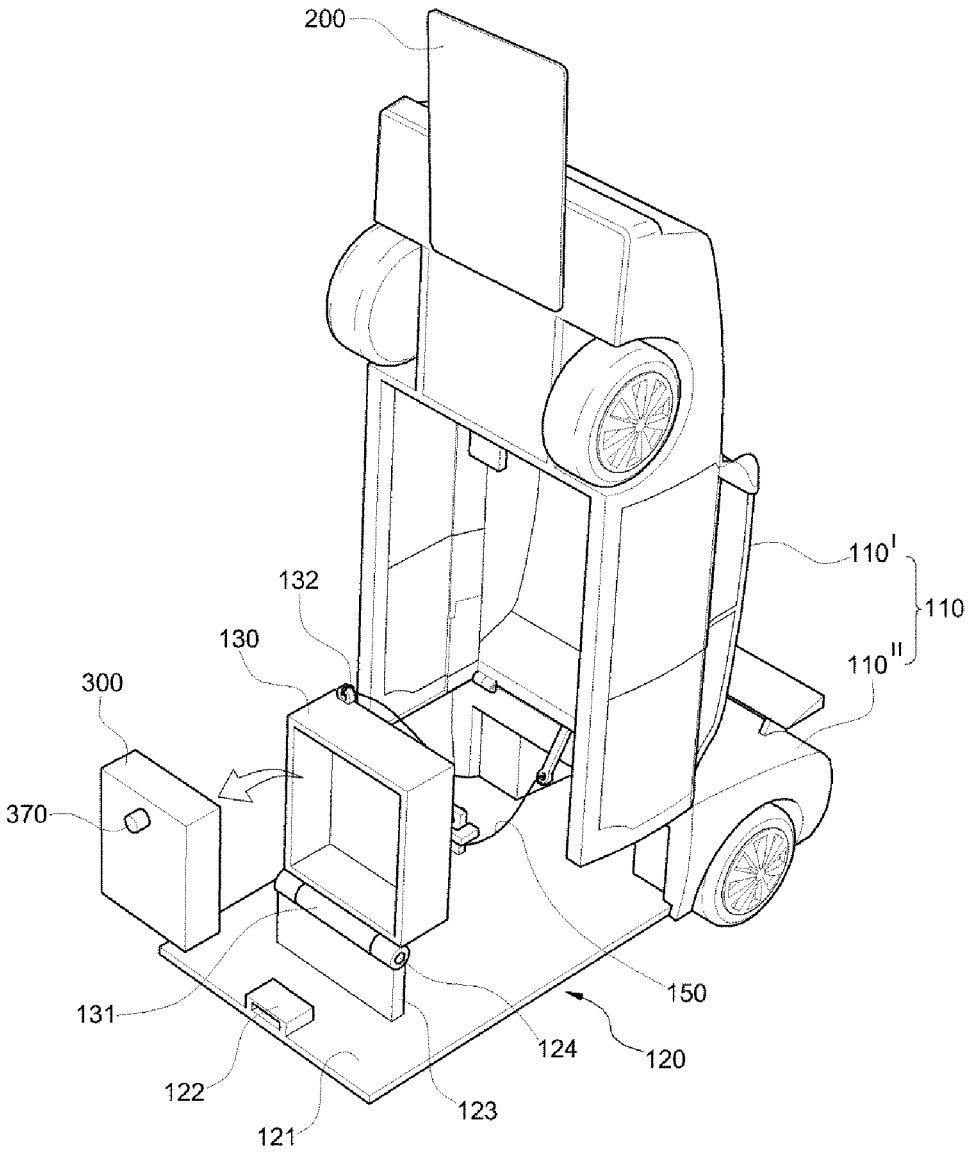

【FIG. 3】
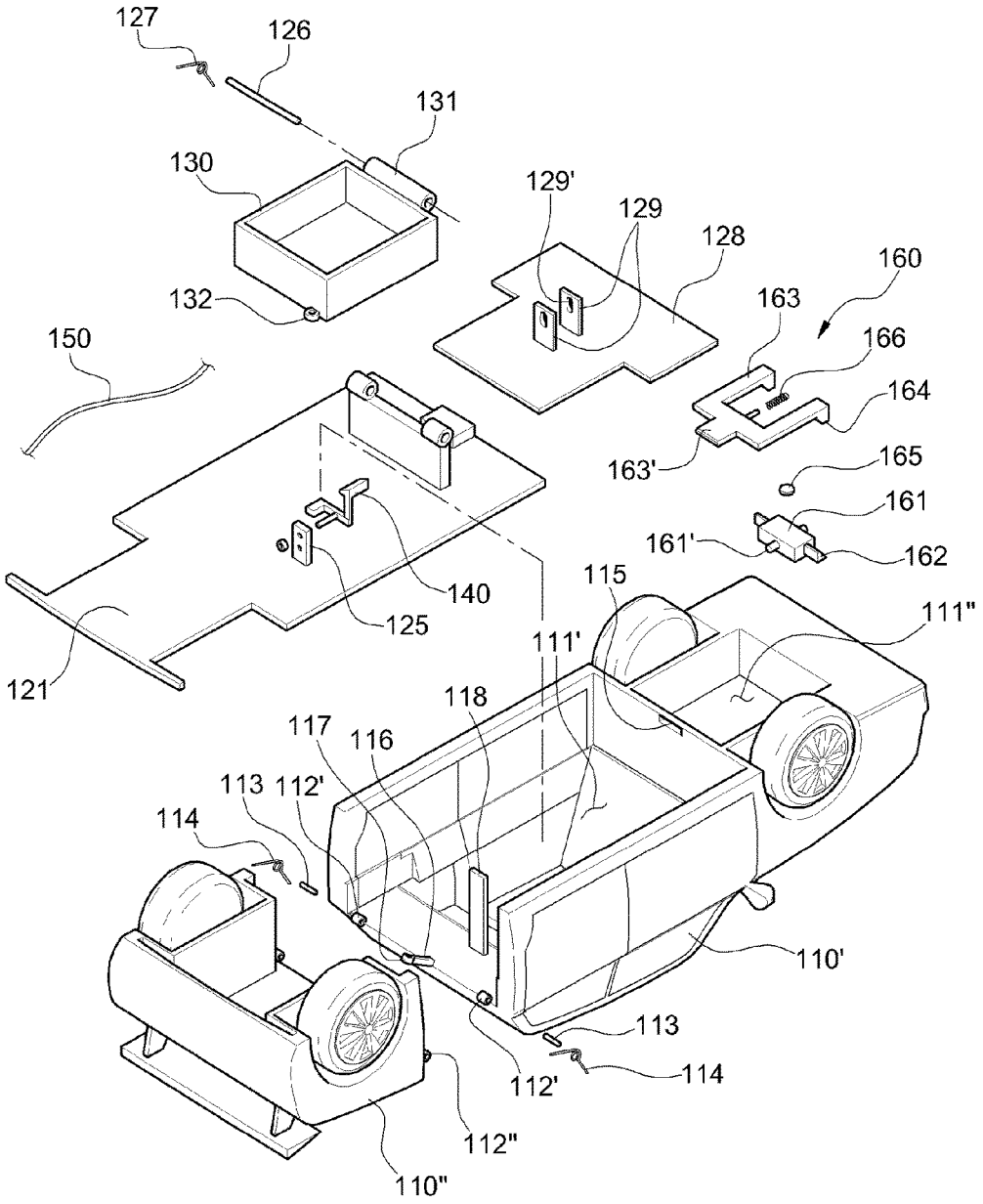

【FIG. 4】
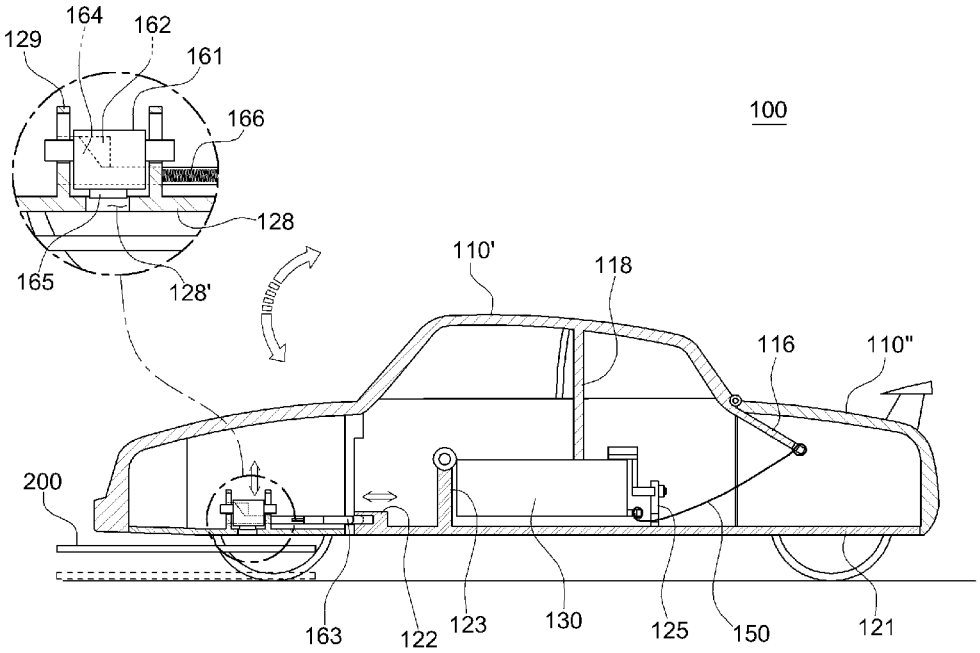

【FIG. 5】
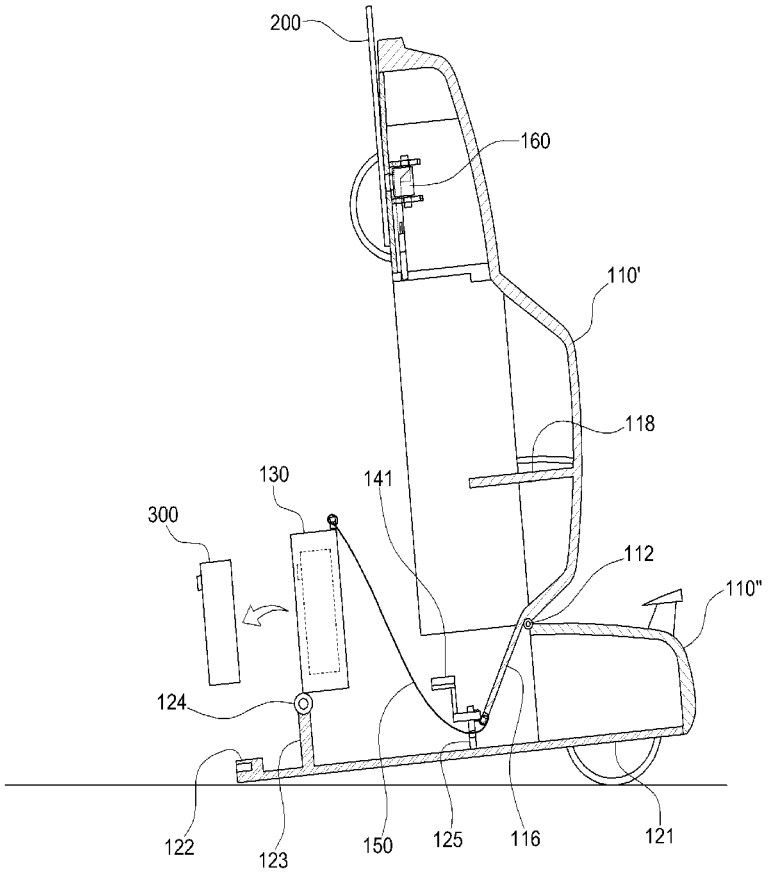

【FIG. 6】
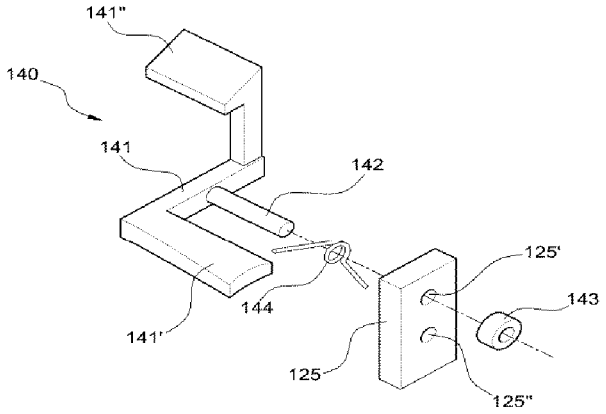
【FIG. 7】
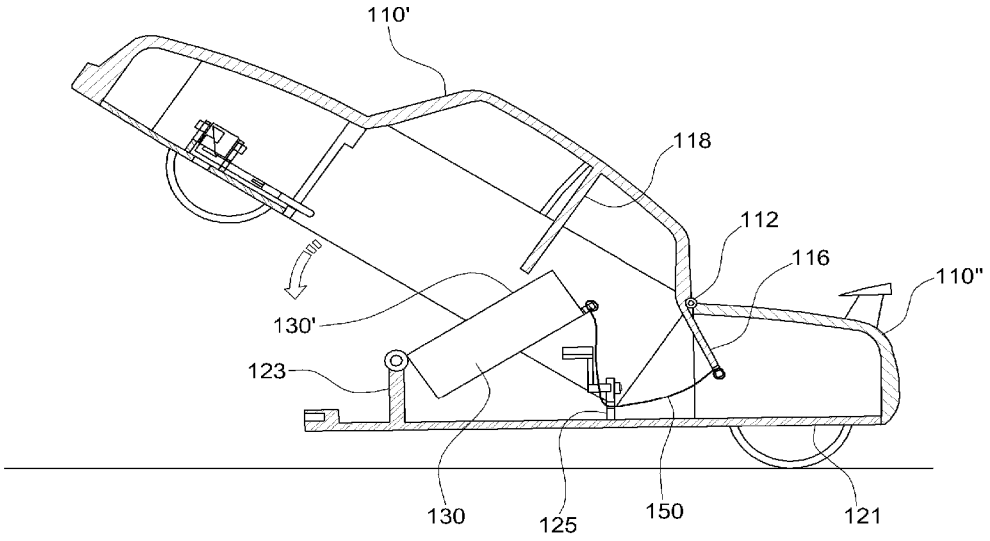

【FIG. 8】
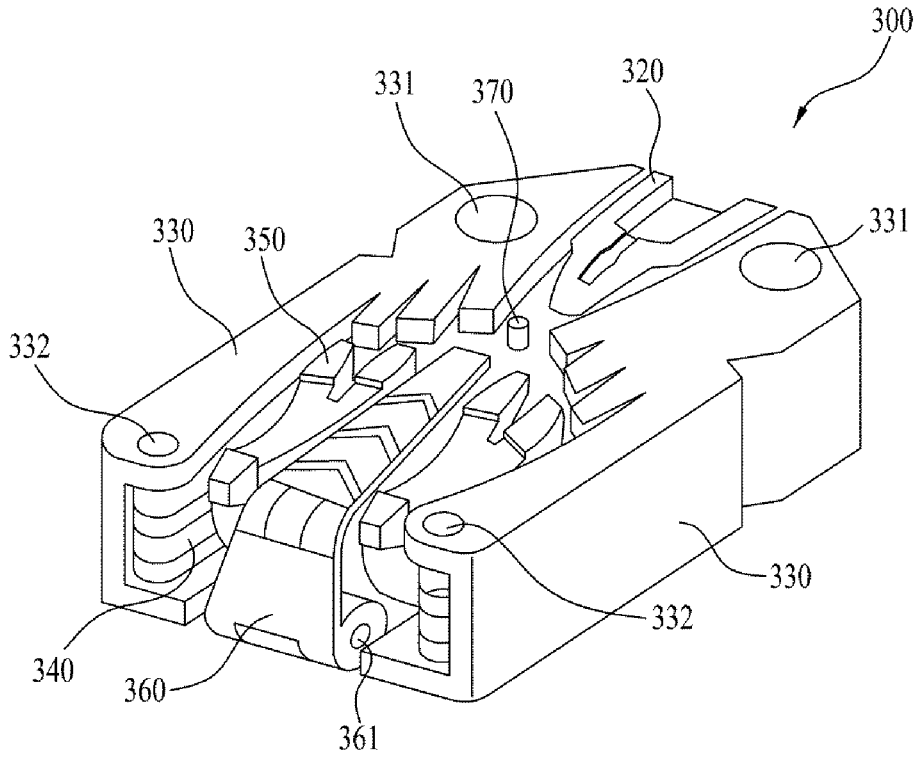
【FIG. 9】
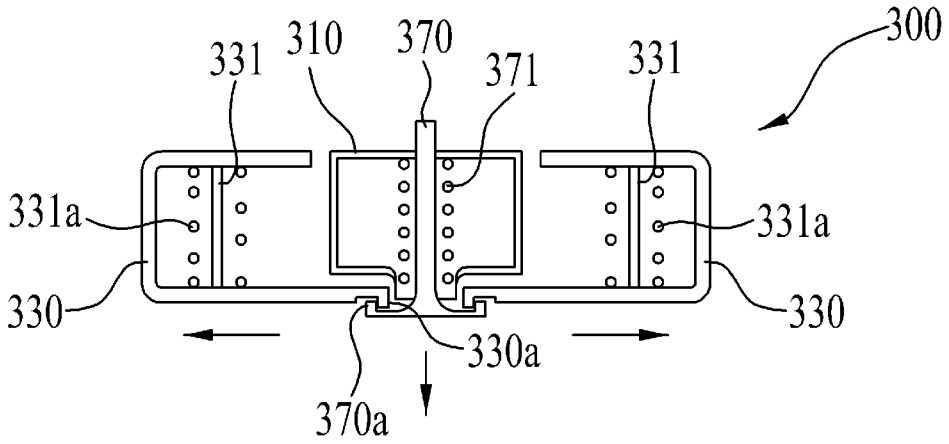

【FIG. 10】
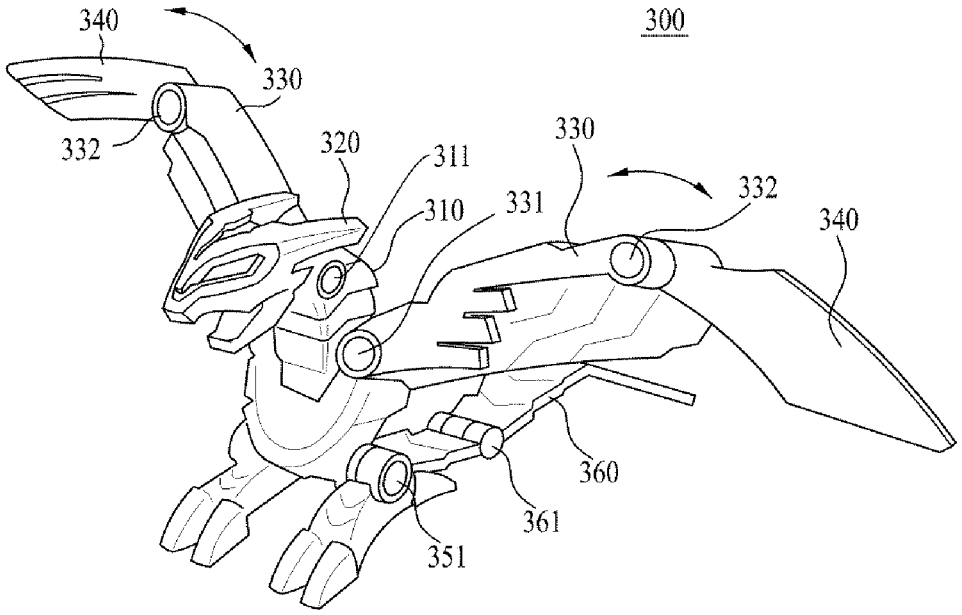

【FIG. 11】
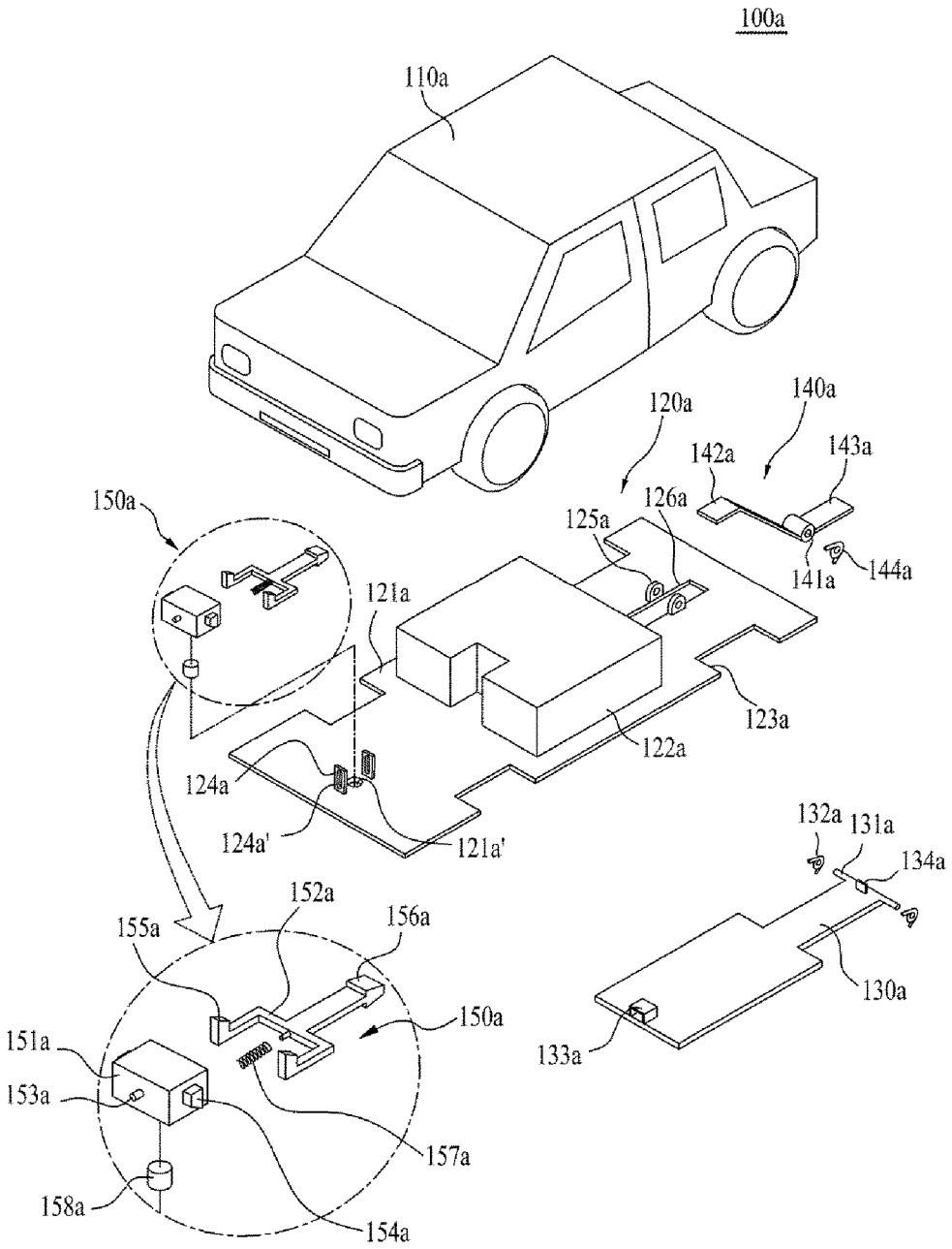

【FIG. 12】
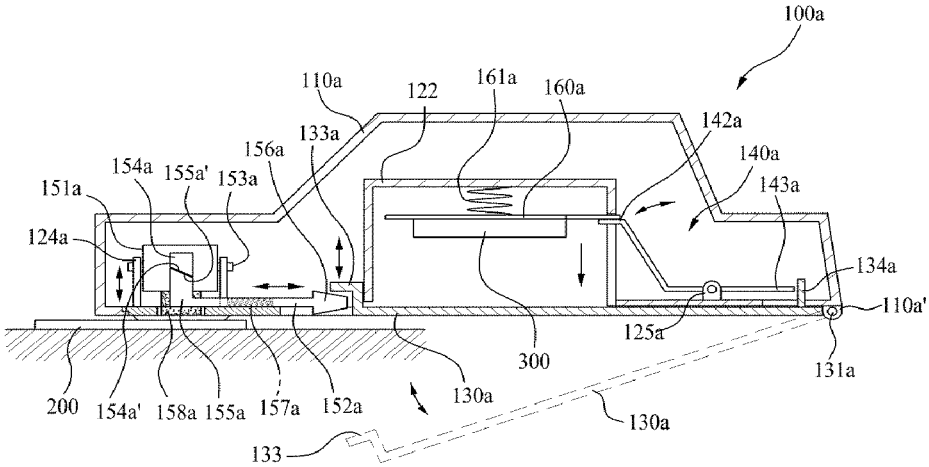
【FIG. 13】
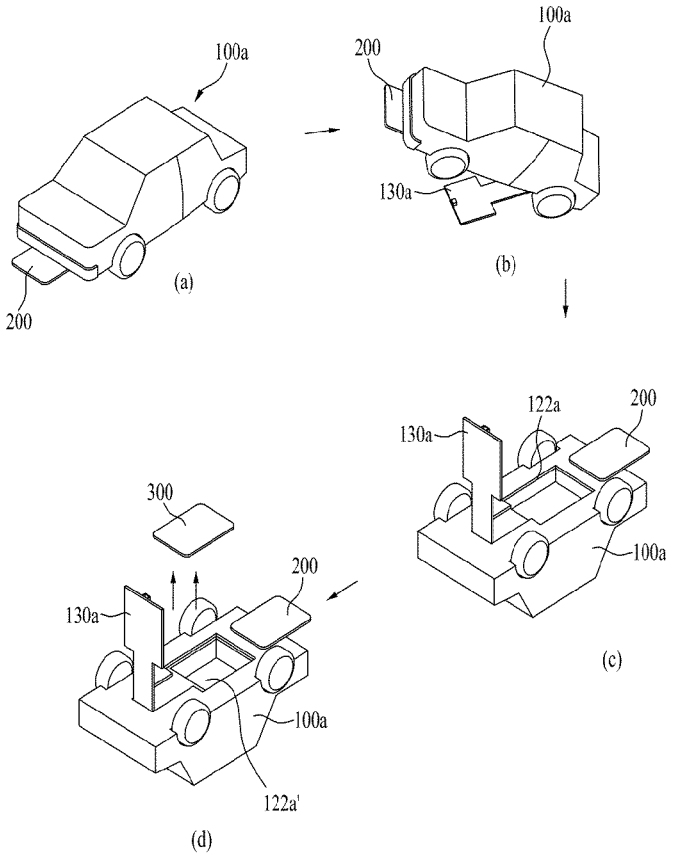

【FIG. 14】
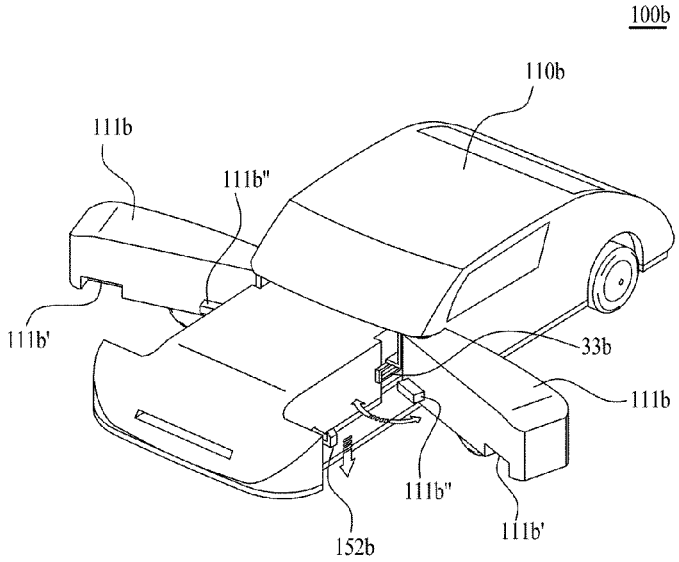

【FIG. 15】
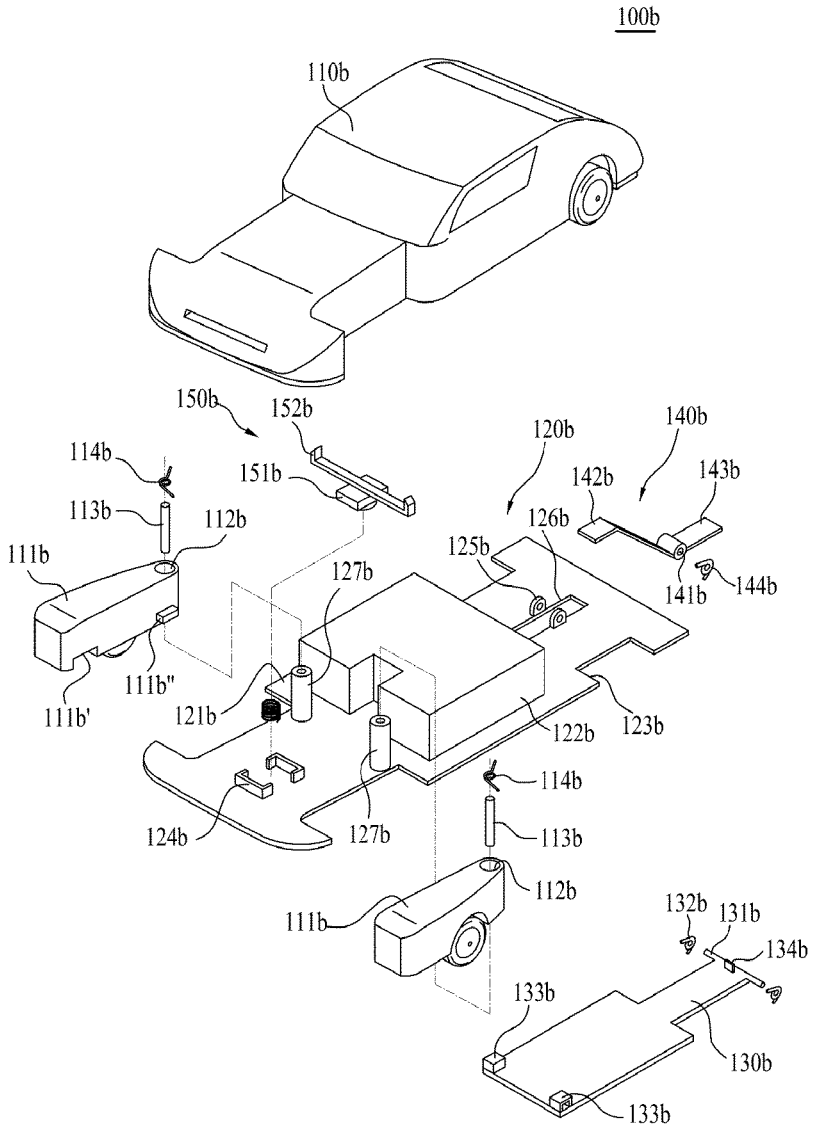

【FIG. 16】
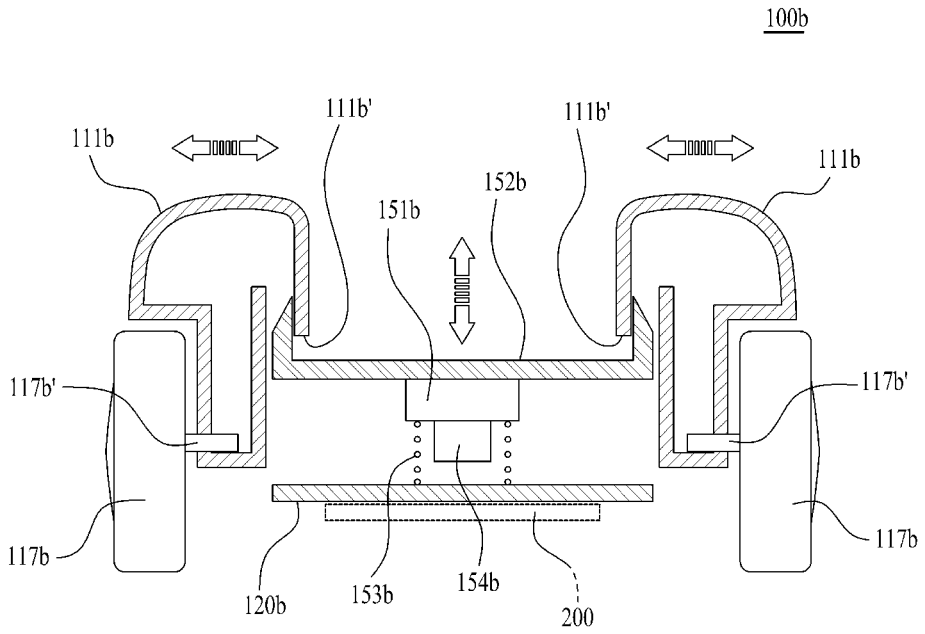

【FIG. 17】
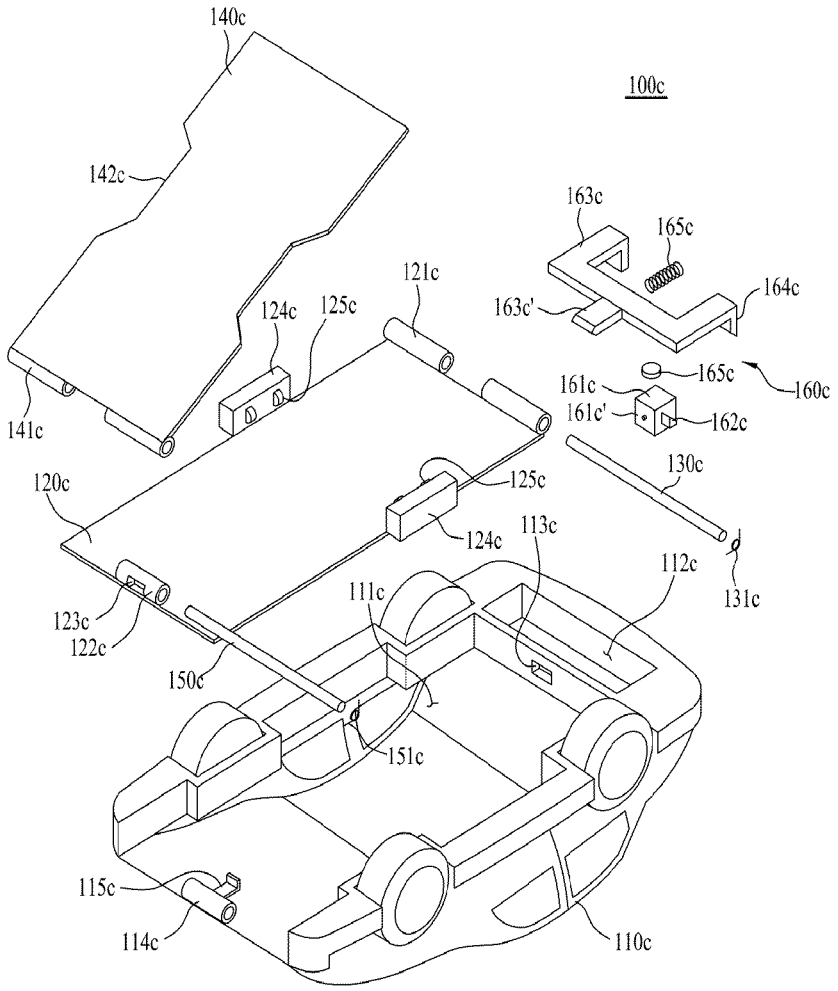

【FIG. 18】
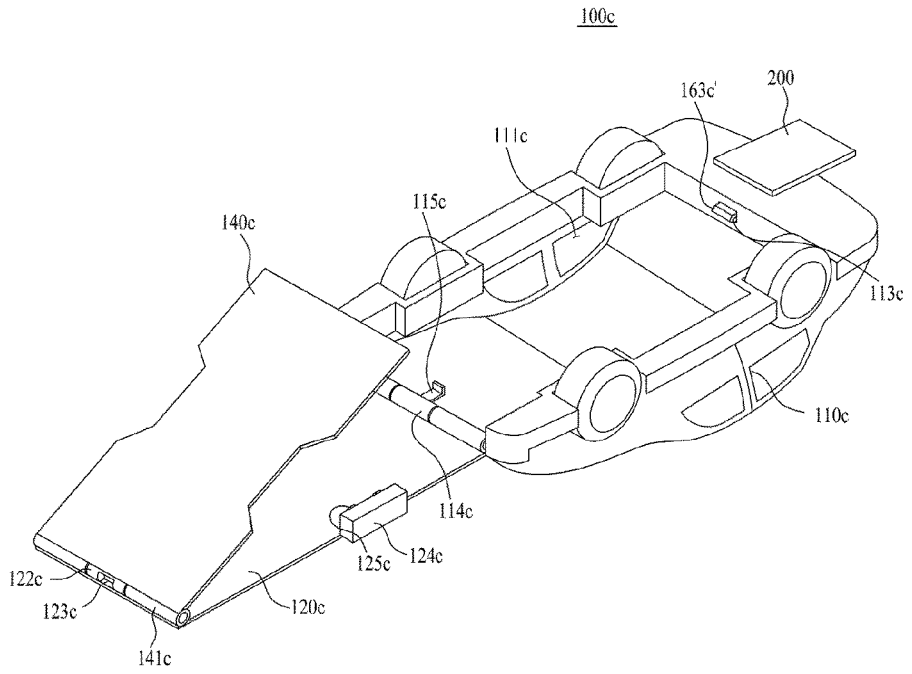
【FIG. 19】
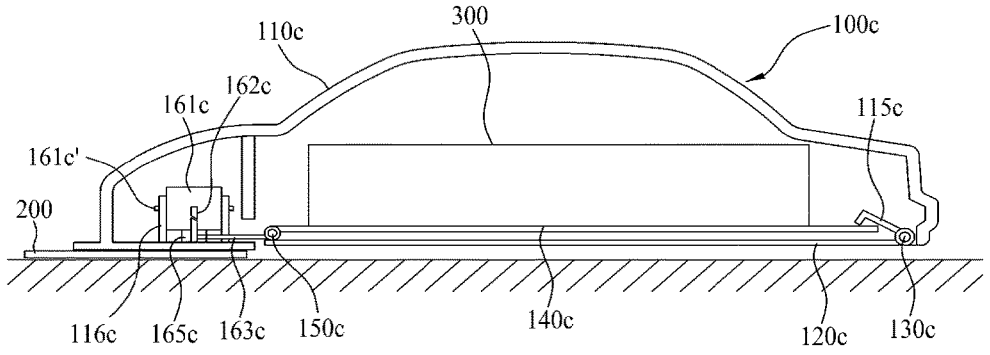

【FIG. 20】
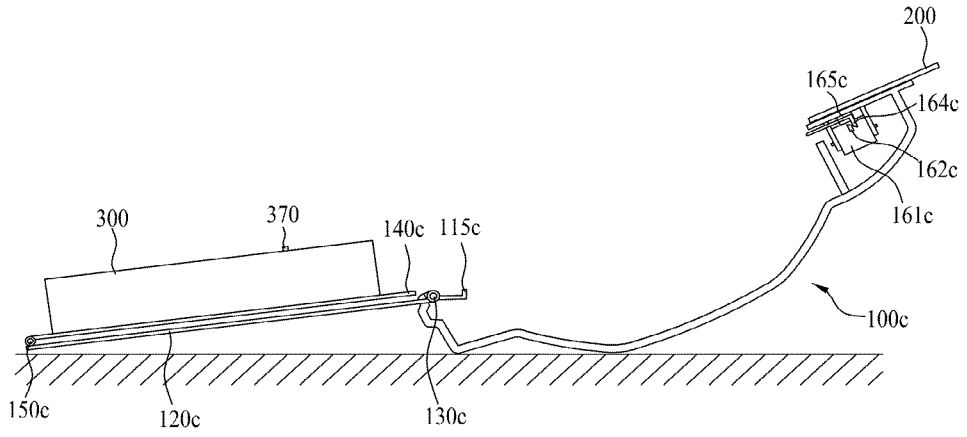
【FIG. 21】
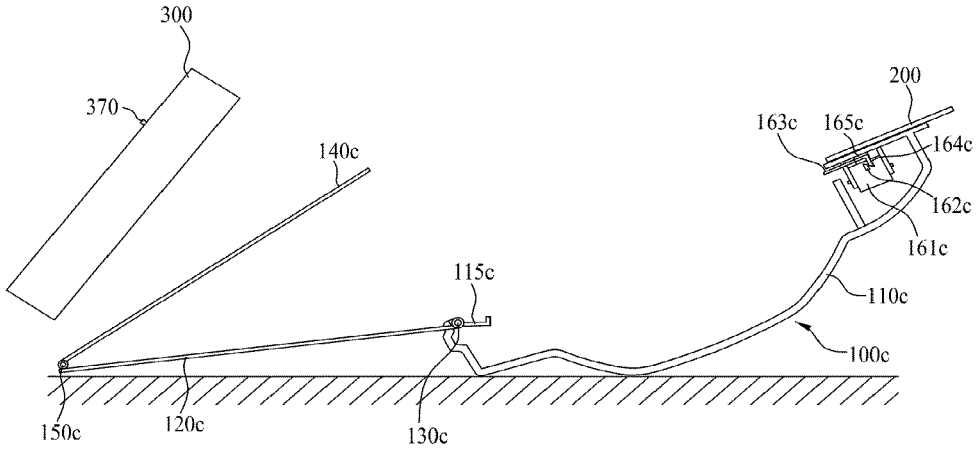

【FIG. 22】
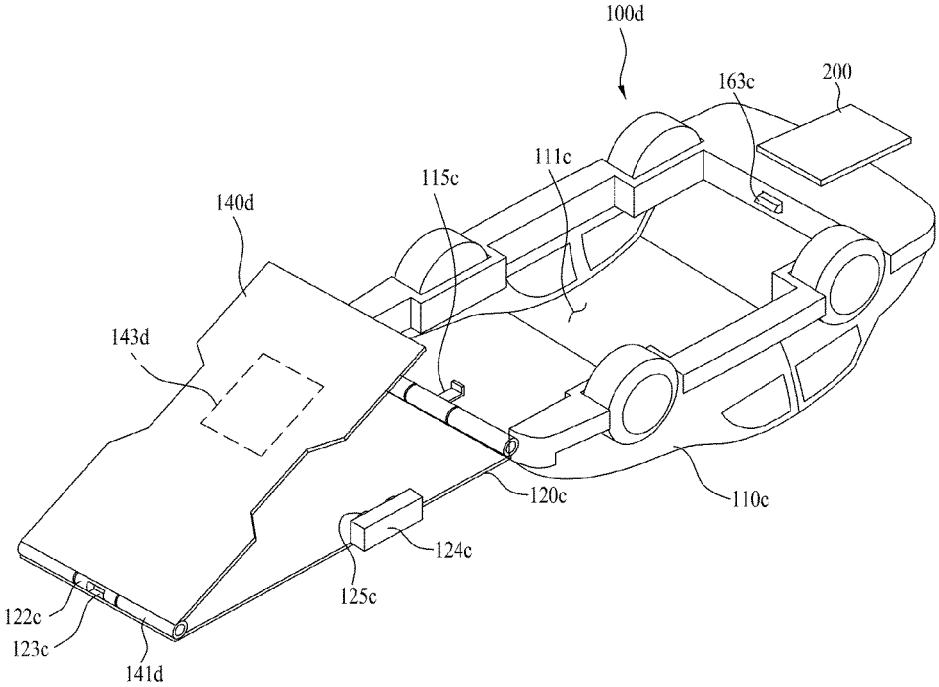
【FIG. 23】
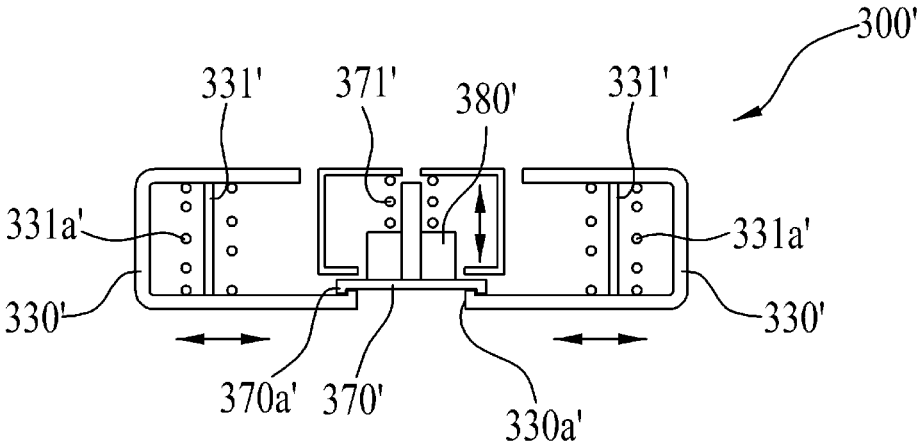

【FIG. 24】
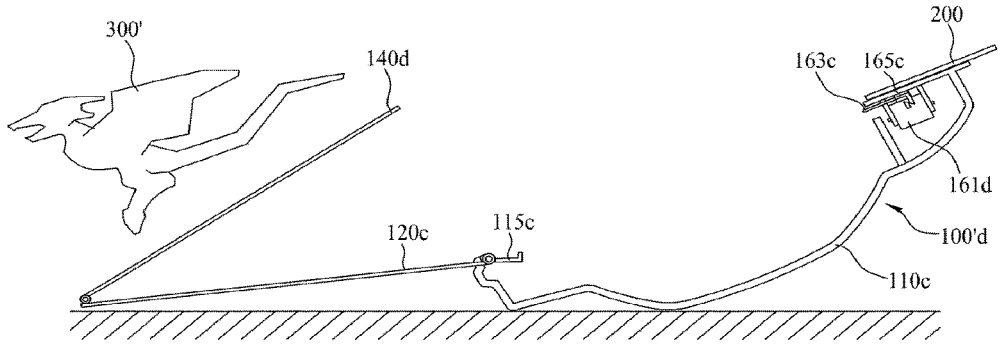
【FIG. 25】
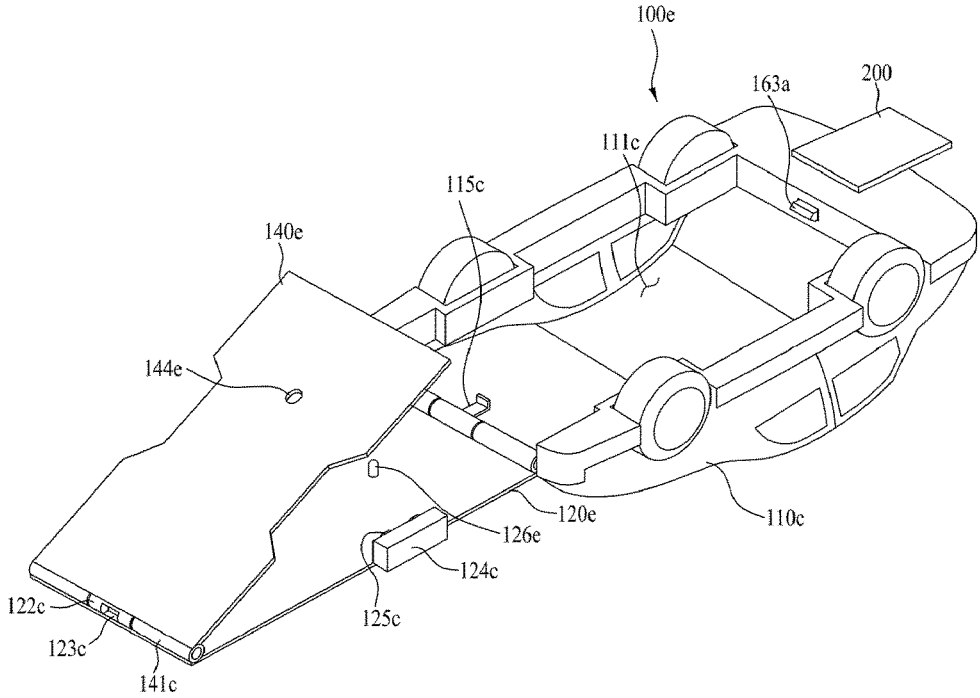

【FIG. 26】
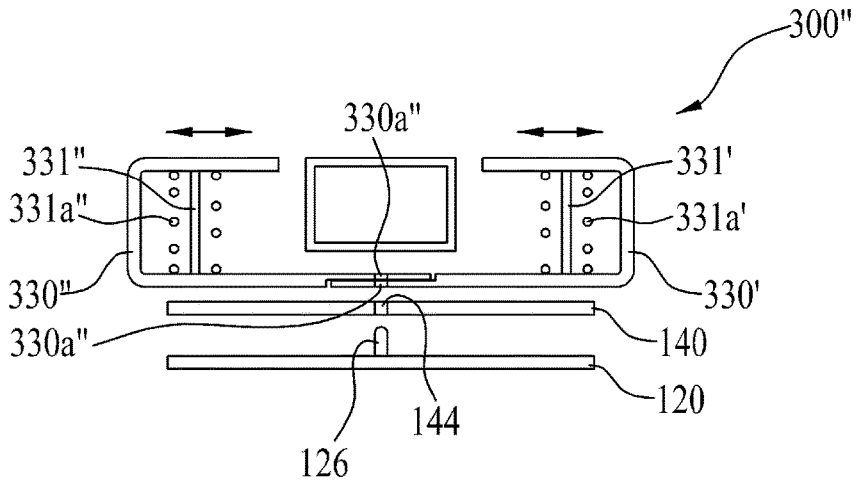
【FIG. 27】
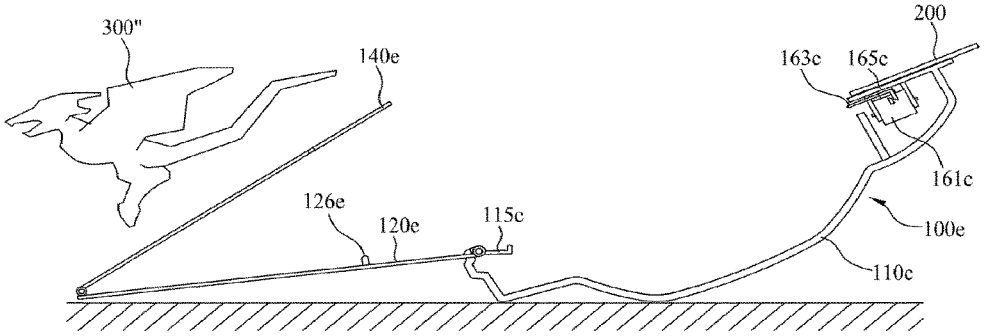

【FIG. 28】
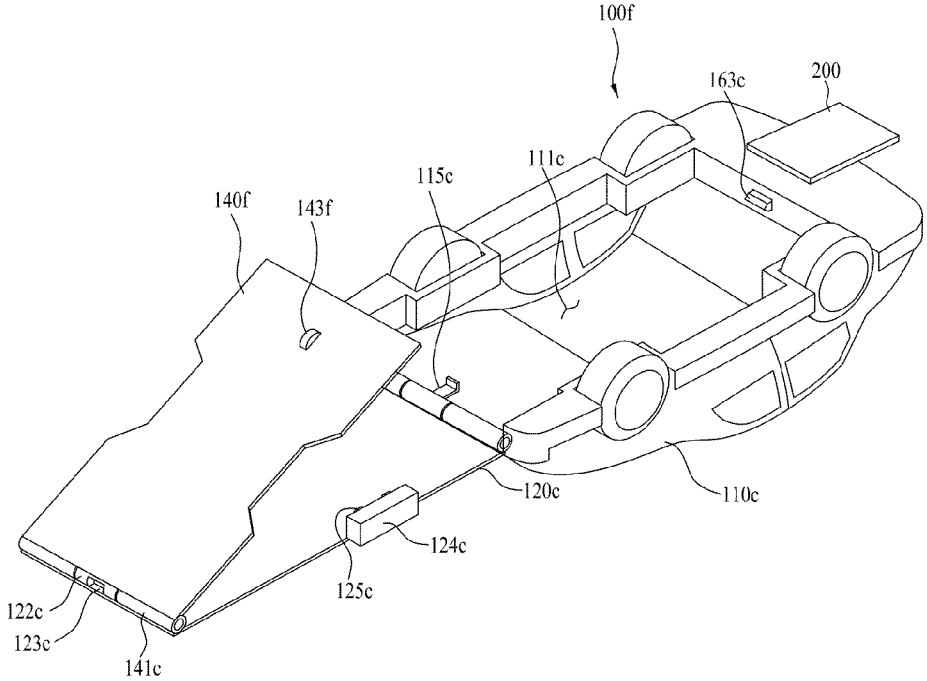
【FIG. 29】
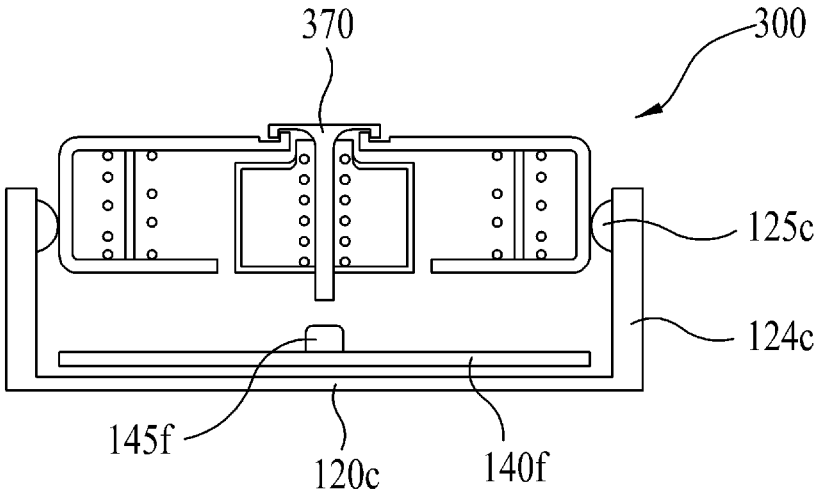

【FIG. 30】
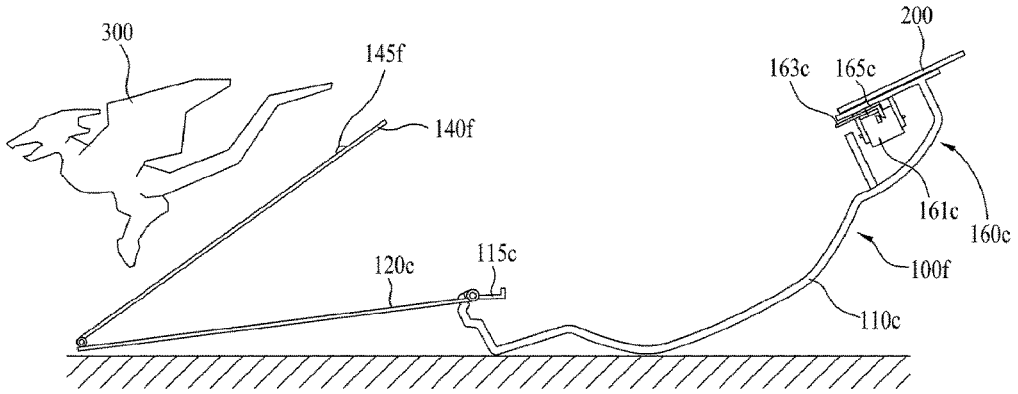

【FIG. 31】
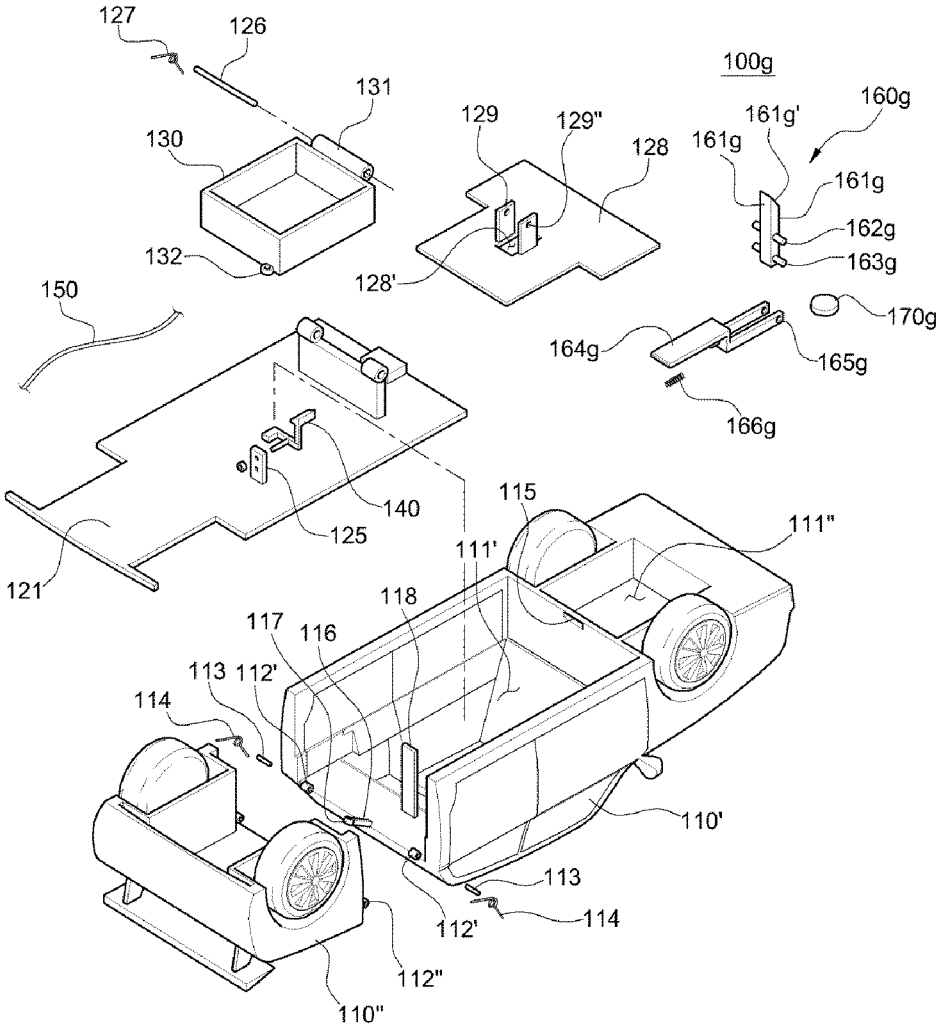

【FIG. 32】
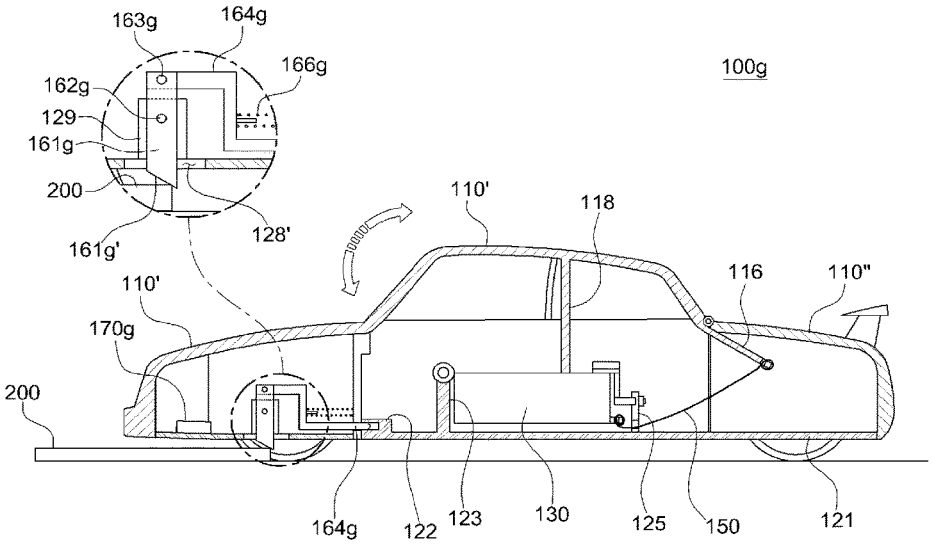
【FIG. 33】
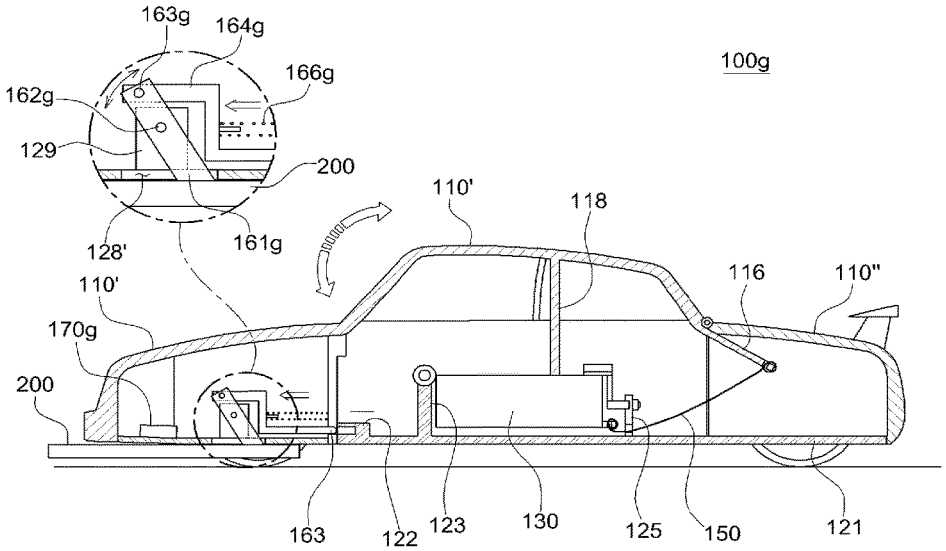

【FIG. 34】
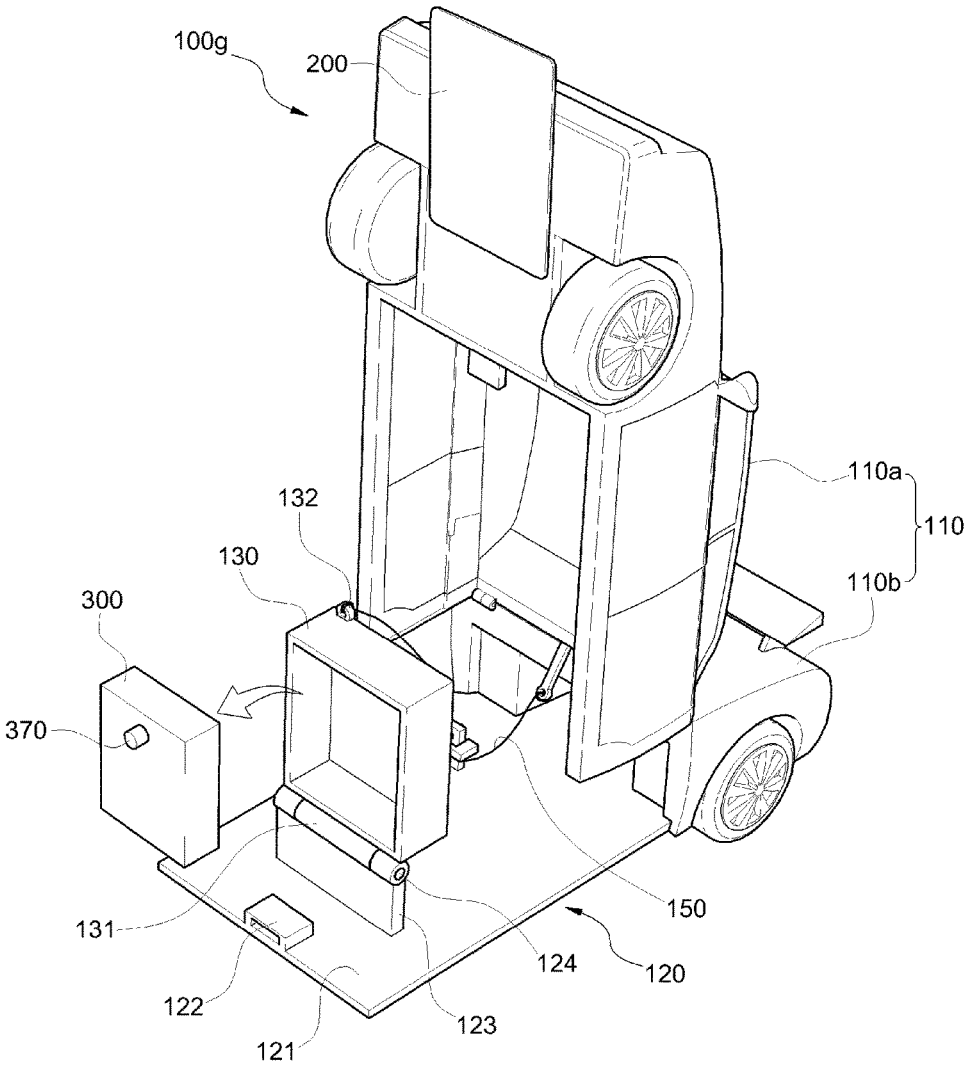

TRANSFORMABLE TOY

CROSS-REFERENCE TO RELATED APPLICATIONS

This application claims the benefit under 35 USC 119(a) of PCT Application No. PCT/KR2015/004711, filed on May 12, 2015.

TECHNICAL FIELD

The present invention relates to a transforming toy, and more particularly, to a transforming toy which enables a toy in a first form to transform into a second form by means of given lock releasing means to discharge an item accommodated therein, and enables an easy return from the transformed second form to the first form.

BACKGROUND ART

A transforming toy has a plurality of body parts having a form of a robot or car, and through the assembly of the body parts, it can transform into the robot or car toy. As the single toy transforms into various forms, children can enjoy a variety of plays through the transform forms produced by the direct assembling of the toy.

In case of generally known card plays for children, on the other hand, drawings or characters for the plays are printed on the top or underside surfaces of rectangular cards, and the cards are turned over to check the information printed on the cards in accordance with given game rules.

Such card plays for children are carried out by placing the cards on a floor by users and turning them over to check the information printed on the cards, so that the playing way is very simple to easily make the users, especially children feel bored and to provide just a function of collecting the drawings or characters printed on the cards.

According to a conventional practice, a transformer toy car is disclosed in Korean Patent Application Laid-open No. 10-2013-0097615 (entitled "transformer toy car and playing device using the same"), wherein if a given card is attached to the underside of a toy car, the toy car is turned over to allow the underside of the attached card to be exposed to the outside.

However, the transformer toy car according to the conventional practice just conducts car turnover, together with simple card plays, so that it is difficult to continuously maintain the excitement in the children's card game.

DISCLOSURE

Technical Problem

Accordingly, the present invention has been made in view of the above-mentioned problems occurring in the prior art, and it is an object of the present invention to provide a transforming toy which enables a toy in a first form to transform into a second form by means of given lock releasing means to discharge an item accommodated therein, and enables an easy return from the transformed second form to the first form.

Technical Solution

To accomplish the above object, according to the present invention, there is provided a transforming toy including: a locking part adapted to maintain a first form of the transforming toy in a locked state to allow an item accommodated in the transforming toy to be fixed to the transforming toy, wherein if the locking part is released from the locked state through the attachment to lock releasing means, the transforming toy transforms into a second form from the first form to allow the item accommodated therein to be released from the fixed state so that the item is discharged to the outside.

According to the present invention, desirably, the transforming toy has a form of any one selected from an electrically movable car, character, object, animal, and doll.

According to the present invention, desirably, the transforming toy further includes: an upper housing having a plurality of housings foldable to each other in such a manner as to have accommodation spaces formed at the inside thereof and adapted to maintain any one selected from the first form and the second form; a lower housing located under the upper housing to supportingly maintain the upper housing to the first form; a throwing part rotatably coupled to the lower housing by means of a support stand hinge and a rotary shaft in such a manner as to pressurize the item by means of the elastic force of a spring mounted on the rotary shaft and thus to throw the item to the outside; a latch part located on the lower housing in such a manner as to operate to allow the throwing part to be rotated and thus released from the locked state if the upper housing transforms into the second form; and the locking part located in the upper housing in such a manner as to be changed to a lock releasing position by means of the formation of a magnetic force together with the lock releasing means so that the upper housing is separated from the lower housing and transforms into the second form.

According to the present invention, desirably, the transforming toy further includes: an upper housing having a plurality of housings foldable to each other in such a manner as to have accommodation spaces formed at the inside thereof and adapted to maintain any one selected from the first form and the second form; a lower housing located under the upper housing to supportingly maintain the upper housing to the first form; a throwing part rotatably coupled to the lower housing by means of a support stand hinge and a rotary shaft in such a manner as to pressurize the item by means of the elastic force of a spring mounted on the rotary shaft and thus to throw the item to the outside; a latch part located on the lower housing in such a manner as to operate to allow the throwing part to be rotated and thus released from the locked state if the upper housing transforms into the second form; the locking part located in the upper housing in such a manner as to be changed to a lock releasing position by means of the physical contact with the lock releasing means so that the upper housing is separated from the lower housing and transforms into the second form; and a magnet adapted to form a magnetic field together with the lock releasing means physically contacted therewith in such a manner as to allow the lock releasing means to be attached to the underside of the upper housing.

According to the present invention, desirably, the transforming toy further includes: returning means connected between the upper housing and the throwing part in such a manner as to pullingly return the throwing part to an original position thereof if the upper housing transformed into the second form is returned to the first form.

According to the present invention, desirably, the transforming toy further includes: an auxiliary lever disposed at the inside of the upper housing in such a manner as to allow a portion of the upper housing returned to the first form to contactedly pressurize the upper portion of the throwing part and thus to return the throwing part to the original position thereof.

According to the present invention, desirably, the transforming toy further includes: an upper housing having an accommodation space formed at the inside thereof; a lower housing located under the upper housing to form an accommodation space in which the item is accommodated; a pressurizing part adapted to cover the accommodation space of the lower housing in such a manner as to be rotatably coupled to the lower portion of the lower housing through a pressurizing part rotary shaft and to pressurize a floor through the elastic forces of springs in such a manner as to allow the upper housing and the lower housing to transform into the second form from the first form; a first locking part located on one side of the lower housing in such a manner as to be movable in accordance with the rotation positions of the pressurizing part to allow a discharging part to be locked or released from the locked state; a second locking part located on the lower housing in such a manner as to fix the pressurizing part thereto and changed to a lock releasing position through at least one of the attachment to the lock releasing means by means of a magnetic force and the physical contact with the lock releasing means to allow the pressuring part to rotate; and the discharging part disposed in the accommodation space of the lower housing in such a manner as to be released from the locked state with the first locking part to pressurizingly discharge the item to the outside if the upper housing and the lower housing are turned over and thus transform into the second form by means of the pressurizing part.

According to the present invention, desirably, the second locking part includes: a second locking part body moving upwardly and downwardly; a slide member locked onto the second locking part body in such a manner as to move horizontally in accordance with the upward and downward movements of the second locking part body; second locking part slant portions formed on both side walls of the second locking part body in such a manner as to be locked onto the slide member to pressurizingly move the slide member horizontally; slide member slant portions protruding upwardly from one side of the slide member in such a manner as to be locked onto the second locking part slant portions; a slide member latch extended by a given length from the other side of the slide member slant portions to allow the pressurizing part to be locked or released from the locked state; a spring adapted to provide an elastic force so that the slide member is maintained at a given position on one side of the second locking part body; and a magnet located on the underside of the second locking part body in such a manner as to allow the second locking part body to move downwardly and be thus attached to the item.

According to the present invention, desirably, the transforming toy further includes: an upper housing having an accommodation space formed at the inside thereof; a plurality of fenders rotatably disposed horizontally on both sides of the upper housing in such a manner as to be separated from the upper housing to allow a pressurizing part to be operated if a second locking part is operated and released from the locked state thereof; a lower housing located under the upper housing to form an accommodation space in which the item is accommodated; the pressurizing part adapted to cover the accommodation space of the lower housing in such a manner as to be rotatably coupled to the lower portion of the lower housing through a pressurizing part rotary shaft and to pressurize a floor through the elastic forces of springs in such a manner as to allow the upper housing and the lower housing to transform into the second form from the first form; a first locking part located on one side of the lower housing in such a manner as to be movable in accordance with the rotation positions of the pressurizing part to allow a discharging part to be locked or released from the locked state; a second locking part located on the lower housing in such a manner as to fix the pressurizing part thereto and changed to a lock releasing position through at least one of the attachment to the lock releasing means by means of a magnetic force and the physical contact with the lock releasing means to allow the pressuring part to rotate; and the discharging part disposed in the accommodation space of the lower housing in such a manner as to be released from the locked state onto the first locking part to pressurizingly discharge the item to the outside if the upper housing and the lower housing are turned over and thus transform into the second form by means of the pressurizing part.

According to the present invention, desirably, the second locking part includes: a second locking part body movable upwardly and downwardly and having a second locking part latch disposed on top thereof in such manner as to be locked onto the fenders to allow the fenders to be fixed to both sides of the upper housing; a second locking part spring located between the second locking part body and the lower housing to provide an elastic force in such a manner as to allow the second locking part body to be maintained at a given position; and a magnet located on the underside of the second locking part body in such a manner as to allow the second locking part body to move downwardly and be thus attached to the item.

According to the present invention, desirably, the transforming toy further includes: a housing having an accommodation space formed at the inside thereof; a pressurizing part rotatably coupled to the lower portion of the housing through a housing hinge and a first rotary shaft and to pressurize a floor through the elastic force of a first spring mounted on the first rotary shaft to allow the housing to transform into the second form from the first form; a throwing part rotatably coupled to one side of the pressurizing part by means of a second pressurizing part hinge and a second rotary shaft in such a manner as to pressurize the item by means of the elastic force of a second spring mounted on the second rotary shaft and thus to throw the item to the outside of the housing; and the locking part located on the housing and changed to a lock releasing position through at least one of the attachment to the lock releasing means by means of a magnetic force and the physical contact with the lock releasing means to allow the pressuring part to rotate.

According to the present invention, desirably, the housing further includes a housing latch protruding from the housing hinge in such a manner as to pressurize one side surface of the throwing part and thus to allow the throwing part to rotate after a given period of time passes.

According to the present invention, desirably, the pressurizing part further includes a pair of item supports adapted to come into close contact with both sides of the item in such a manner as to fix the item thereto.

According to the present invention, desirably, the pressurizing part further includes a protrusion extended by a given length from top thereof.

According to the present invention, desirably, the throwing part further includes any one of a throwing part magnetic material having any one of a magnetic material and a magnet adapted to form a magnetic field, a throwing part through hole formed to pass the body thereof therethrough, and a throwing part protrusion protruding by a given length from top of the body thereof.

According to the present invention, desirably, the locking part includes: a locking part body; locking part slant surfaces formed on both side walls of the locking part body; a slide member having slide member slant surfaces locked onto the locking part slant surfaces and adapted to be changed in position to allow the pressurizing part to be locked or released from the locked state in accordance with the upward and downward movements of the locking part body; a magnet located on the locking part body in such a manner to form a magnetic field together with the lock releasing means to provide a driving force so that the locking part body moves; and a spring adapted to provide an elastic force in such a manner as to allow the slide member to be maintained at a given position.

According to the present invention, desirably, the lock releasing means has a magnetic material disposed in the interior thereof.

According to the present invention, desirably, the item is a member or card having any one selected from an animal, object, doll and character.

According to the present invention, desirably, the item includes: an item body; a plurality of rotary members foldably disposed on the item body by means of a plurality of item hinges; a plurality of fourth springs adapted to provide elastic forces to allow the rotary members to be unfoldable around the plurality of item hinges; and an item locking part changed in position to allow the item to be maintained to any one of a first form in which the item is folded and a second form in which the item is unfolded.

According to the present invention, desirably, the item further includes an item magnet having any one of a magnetic material and a magnet so as to form a magnetic field.

According to the present invention, desirably, the item includes: an item body; a plurality of rotary members foldably disposed on the item body by means of a plurality of item hinges; a plurality of fourth springs adapted to provide elastic forces to allow the rotary members to be unfoldable around the plurality of item hinges; and coupling holes formed piercedly on the plurality of rotary members to have a concentric axis with each other.

Advantageous Effects

According to the present invention, the transforming toy in the first form can transform into the second form if the given lock releasing means is attached to the toy in the first form, and accordingly, the item accommodated in the toy is discharged to the outside, thereby increasing the excitement in playing games.

Further, the transforming toy enables a rapid return from the transformed second form to the first form.

DESCRIPTION OF DRAWINGS

FIG. 1 is a perspective view showing a transforming toy according to the present invention.

FIG. 2 is a perspective view showing a transforming toy according to a first embodiment of the present invention.

FIG. 3 is an exploded perspective view showing the configuration of the transforming toy according to the first embodiment of the present invention.

FIG. 4 is a sectional view showing an operating process of the transforming toy according to the first embodiment of the present invention.

FIG. 5 is a sectional view showing another operating process of the transforming toy according to the first embodiment of the present invention.

FIG. 6 is an exploded perspective view showing throwing part locking means of the transforming toy according to the first embodiment of the present invention.

FIG. 7 is a sectional view showing yet another operating process of the transforming toy according to the first embodiment of the present invention.

FIG. 8 is a perspective view showing an item of the transforming toy according to the present invention.

FIG. 9 is a sectional view showing the structure of the item of FIG. 8.

FIG. 10 is a perspective view showing the unfolded state of the item of FIG. 8.

FIG. 11 is an exploded perspective view showing the configuration of a transforming toy according to a second embodiment of the present invention.

FIG. 12 is a sectional view showing an operating process of the transforming toy according to the second embodiment of the present invention.

FIGS. 13*a* to 13*d* are perspective views showing other operating processes of the transforming toy according to the second embodiment of the present invention.

FIG. 14 is a perspective view showing a transforming toy according to a third embodiment of the present invention.

FIG. 15 is an exploded perspective view showing the configuration of the transforming toy according to the third embodiment of the present invention.

FIG. 16 is a sectional view showing the configuration of the transforming toy according to the third embodiment of the present invention.

FIG. 17 is an exploded perspective view showing the configuration of a transforming toy according to a fourth embodiment of the present invention.

FIG. 18 is a perspective view showing an operating process of the transforming toy according to the fourth embodiment of the present invention.

FIG. 19 is a sectional view showing another operating process of the transforming toy according to the fourth embodiment of the present invention.

FIG. 20 is a sectional view showing yet another operating process of the transforming toy according to the fourth embodiment of the present invention.

FIG. 21 is a sectional view showing still another operating process of the transforming toy according to the fourth embodiment of the present invention.

FIG. 22 is a perspective view showing a transforming toy according to a fifth embodiment of the present invention.

FIG. 23 is a sectional view showing the structure of an item of the transforming toy according to the fifth embodiment of the present invention.

FIG. 24 is a sectional view showing an operating process of the transforming toy according to the fifth embodiment of the present invention.

FIG. 25 is a perspective view showing a transforming toy according to a sixth embodiment of the present invention.

FIG. 26 is a sectional view showing the structure of an item of the transforming toy according to the sixth embodiment of the present invention.

FIG. 27 is a sectional view showing an operating process of the transforming toy according to the sixth embodiment of the present invention.

FIG. 28 is a perspective view showing a transforming toy according to a seventh embodiment of the present invention.

FIG. 29 is a sectional view showing the structure of an item of the transforming toy according to the seventh embodiment of the present invention.

FIG. 30 is a sectional view showing an operating process of the transforming toy according to the seventh embodiment of the present invention.

FIG. 31 is an exploded perspective view showing a transforming toy according to an eighth embodiment of the present invention.

FIG. 32 is a sectional view showing an operating process of the transforming toy according to the eighth embodiment of the present invention.

FIG. 33 is a sectional view showing another operating process of the transforming toy according to the eighth embodiment of the present invention.

FIG. 34 is a perspective view showing the operating process of the transforming toy according to the eighth embodiment of the present invention.

MODE FOR INVENTION

Hereinafter, an explanation on a transforming toy according to the present invention will be in detail given with reference to the attached drawing.

(First Embodiment)

FIG. 1 is a perspective view showing a transforming toy according to the present invention, FIG. 2 is a perspective view showing a transforming toy according to a first embodiment of the present invention, FIG. 3 is an exploded perspective view showing the configuration of the transforming toy according to the first embodiment of the present invention, FIG. 4 is a sectional view showing an operating process of the transforming toy according to the first embodiment of the present invention, FIG. 5 is a sectional view showing another operating process of the transforming toy according to the first embodiment of the present invention, FIG. 6 is an exploded perspective view showing throwing part locking means of the transforming toy according to the first embodiment of the present invention, FIG. 7 is a sectional view showing yet another operating process of the transforming toy according to the first embodiment of the present invention, FIG. 8 is a perspective view showing an item of the transforming toy according to the present invention, FIG. 9 is a sectional view showing the structure of the item of FIG. 8, and FIG. 10 is a perspective view showing the unfolded state of the item of FIG. 8.

As shown in FIGS. 1 to 10, a transforming toy 100 according to a first embodiment of the present invention includes an upper housing 110, a lower housing 120, a throwing part 130, a latch part 140, returning means 150, a locking part 160, lock releasing means 200, and an item 300, wherein the locking part 160 maintains the transforming toy 100 to a first form in a locked state to allow the item 300 accommodated in the transforming toy 100 to be fixed to the transforming toy 100, and if the locking part 160 is released from the locked state thereof through the attachment to the lock releasing means 200, the transforming toy 100 transforms into a second form from the first form to allow the item 300 accommodated therein to be released from the fixed state thereof so that the item 300 is discharged to the outside.

The transforming toy 100 has a form of any one selected from an electrically movable car, character, object, animal, and doll, and desirably, it has a form of a car.

According to the present invention, the transforming toy has a form of a car, for the brevity of the description, but of course, it may have all forms having electrically movable wheels.

The upper housing 110 has an accommodation space formed at the inside thereof and is a car-shaped member having a first housing 110' and a second housing 110" foldable to each other by means of first housing hinges 112', second housing hinges 112" and rotary shafts 113. Desirably, the upper housing 110 maintains any one selected from the car form as the first form and the second form produced by upwardly rotating the first housing 110' around the rotary shafts 113 and erecting the first housing 110' up.

Further, springs 114 are mounted on the rotary shafts 113 to provide elastic forces so that the first housing 110' can rotate.

Furthermore, the first housing 110' is divided into a first accommodation portion 111' in which the throwing part 130 is accommodated and a second accommodation portion 111" in which the locking part 160 is accommodated, and the first housing 110' has a through hole 115 formed between the first accommodation portion 111' and the second accommodation portion 111'.

Also, the first housing 110' includes a lever 116 extended by a given length from the end of one side thereof, so that if the first housing 110' upwardly rotates around the rotary shafts 113, the lever 116 comes into contact with the latch part 140 to operate the latch part 140, thereby releasing the throwing part 130 from the locked state thereof.

The lever 116 has a housing coupling hole 117 formed thereon in such a manner as to be connected to one end of the returning means 150.

Moreover, the upper housing 110 includes an auxiliary lever 118 disposed at the inside thereof in such a manner as to pressurize the upper housing 110 to allow the upper housing 110 to be maintained to the first form, and if the transforming toy 100 is returned to the first form from the second form, the auxiliary lever 118 is adapted to allow a portion of the upper housing 110 to contactedly pressurize the upper portion of the throwing part 130, so that the throwing part 130 is returned to its original position.

The lower housing 120 is located under the upper housing 110 in such a manner as to be locked onto the locking part 160 disposed in the upper housing 110 to supportingly maintain the upper housing 110 to the first form, and the lower housing 120 includes a plate-shaped lower housing body 121, a locking slot 122 formed on top of the lower housing body 121, a first support stand 123, and a second support stand 125.

One side of the lower housing body 121 is fixed to the second housing 110" of the upper housing 110 to allow the first housing 110' to rotate around the rotary shafts 113, so that the transforming toy 100 can transform into the second form from the first form.

The locking slot 122 is formed on the other side of the lower housing body 121 in such a manner as to be locked onto the locking part 160 of the upper housing 110 to allow the locking part 160 to be maintained at the locked state, so that the upper housing 110 can be maintained to the first form.

The first support stand 123 is located on top of the lower housing body 121 to rotatably support the throwing part 120 and includes a support stand hinge 124 disposed on top thereof and a rotary shaft 126 adapted to allow the throwing part 130 to be rotatably coupled to the support stand hinge 124.

Further, the rotary shaft 126 has a spring 127 mounted thereon to provide an elastic force so that the throwing part 130 can rotate around the rotary shaft 126.

The second support stand 125 has a bar-shaped member adapted to supportingly operate the latch part 140 located on top of the lower housing body 121 and includes a first through hole 125' into which the latch part 140 is inserted and a second through hole 125" through which the returning means 150 passes.

On the other hand, the lower housing 120 includes an auxiliary housing 128 disposed on the bottom surface of the second accommodation portion 111" into which the locking part 150 is located.

The auxiliary housing 128 is located on bottom surface of the second accommodation portion 111" and includes a through hole 128', a pair of guides 129 adapted to allow the locking part 160 to be operable upwardly and downwardly, and long holes 129' formed along the longitudinal directions of the guides 129.

The throwing part 130 is a member for providing an accommodation space in which the item 300 is disposed and includes a throwing part hinge 131 rotatably coupled to the support stand hinge 124 of the lower housing 120 by means of the rotary shaft 126, so that the throwing part 130 rotates by a given angle in a given direction through the elastic force of the spring 127 mounted on the rotary shaft 126, thereby throwing the item 300 to the outside.

Further, the throwing part 130 has a throwing part coupling hole 132 formed on one side thereof in such a manner as to be connected to the end of the returning means 150.

The latch part 140 is rotatably located on the second support stand 125 of the lower housing 120 so that if the upper housing 110 transforms into the second form, it operates to allow the throwing part 130 to be released from the locked state thereof, and the latch part 140 includes a latch part body 141, a rotary shaft 142, a nut 143, and a spring 144.

The latch part body 141 has a shape of a bar and includes a first latch 141' formed on one side thereof in such a manner as to come in contact with the lever 116 of the upper housing 110 and a second latch 141" formed on the other side thereof in such a manner as to come into close contact with one side of the upper portion of the throwing part 130.

Further, the latch part body 141 has the rotary shaft 142 protruding from the center thereof, and the rotary shaft 142 is rotatably disposed on the first through hole 125' of the second support stand 125 by means of the fixation of the nut 143 and is maintained at a given position by means of the elastic force of the spring 144.

The returning means 150 is connected between the upper housing 110 and the throwing part 130, and if the upper housing 110 transformed into the second form is returned to the first form, the returning means 150 pulls the throwing part 130 to return the throwing part 130 to its original position. One side of the returning means 150 is connected to the housing coupling hole 117 of the upper housing 110, and the other side thereof is passed through the second through hole 125" in such a manner as to be connected to the throwing part coupling hole 132 of the throwing part 130.

According to the first embodiment of the present invention, the returning means 150 has a form of a wire, but it is not limited thereto. For example, the returning means 150 may be provided as a gear case having a given gear ratio disposed between the upper housing 110 and the throwing part 130 or a link mechanism located between the upper housing 110 and the throwing part 130.

The locking part 160 is located in the second accommodation portion 111" of the upper housing 110, and if the lock releasing means 200 is attached to the locking part 160, the locking part 160 is operated and released from the locking state thereof so that the upper housing 110 is separated from the lower housing 120 and transforms into the second form from the first form. The locking part 160 includes a locking part body 161, a slide member 163, a magnet 165, and a spring 166.

The locking part body 161 is a rectangular member and moves and changed in position in upward and downward directions of the second accommodation portion 111" if the lock releasing means 200 and the magnet 165 come into close contact with each other. The locking part body 161 includes locking part protrusions 161' and locking part slant surfaces 162.

The locking part protrusions 161' protrude by given lengths from the locking part body 161 and are insertedly coupled to the guide through holes 129' of the guides 129 disposed on the auxiliary housing 128 to allow the locking part body 161 to move in the upward and downward directions.

The locking part slant surfaces 162 are formed on both side walls of the locking part body 161 and are locked onto slant surfaces 164 of the slide member 163, so that if the locking part body 161 moves downwardly, they pressurize the slant surfaces 164 of the slide member 163 to allow the slide member 163 to move in a horizontal direction.

The slide member 163 includes the slant surfaces 164 formed on one side thereof in such a manner as to be locked onto the locking part slant surfaces 162 of the locking part body 161 and a slide member latch 163' protruding by a given length from the other side thereof in such a manner as to be inserted into the locking slot 122 of the lower housing 120, so that the slide member 163 moves horizontally in accordance with the upward and downward movements of the locking part body 161 to release the locked state of the locking part 150, thereby allowing the upper housing 110 to transform into the first form or the second form.

The slide member latch 163' passes through the through hole 115 formed between the first accommodation portion 111' and the second accommodation portion 111" and is then inserted into the locking slot 122 of the lower housing 120, thereby allowing the locked state of the locking part 160 to be maintained. Otherwise, the slide member latch 163' is separated from the locking slot 122 of the lower housing 120, thereby allowing the locked state of the locking part 160 to be released.

The magnet 165 is located under the locking part body 161 and forms a magnetic field together with the lock releasing means 200 to provide a driving force with which the locking part body 161 moves to the upward and downward directions.

The spring 166 provides an elastic force so that the slide member 163 can be maintained at a given position (for example, a position capable of allowing the upper housing 110 to be maintained to the first form), and if the locking part body 161 moves downwardly by means of the magnetic field of the magnet 165, the spring 166 is compressed by means of the slide member 163. Further, if the magnetic field produced by the magnet 165 disappears, the spring 166 is expanded by means of its own elastic force to allow the locking part body 161 and the slide member 163 to be returned to their original position.

According to the first embodiment of the present invention, the locking part 160 is configured to slidingly move in the horizontal direction in such a manner as to be released from its locked state, but it is not limited to such configuration. That is, it is obvious to those skilled in the art that the locking part 160 may move in a vertical direction to release the locked state thereof.

The lock releasing means 200 is a paper or plastic resin card as a circular or polygonal member which has a given character, numbers, or game information printed on the surface thereof and a coating layer formed on the surface thereof.

Further, the lock releasing means 200 has a magnetic material disposed in the interior thereof in such a manner as to be attached to the magnet 165 mounted on the locking part 160 to form the magnetic field.

The item 300 is any one character member selected from an animal, object, and doll and includes an item body 310, a plurality of rotary members foldably disposed on the item body 310 by means of a plurality of first to fifth item hinges 311, 331, 332, 351 and 361, a plurality of fourth springs 331*a* adapted to provide elastic forces to allow the rotary members to be unfoldable around the first to fifth item hinges 311, 331, 332, 351 and 361, and an item locking part 370 changed in position to allow the item 300 to be maintained to any one of a first form in which the item 300 is folded and a second form in which the item 300 is unfolded.

The rotary members include an item head 320, first item wings 330, second item wings 340, item legs 350, and an item tail 460, and the rotary members rotate around the item body 310 by means of the first to fifth item hinges 311, 331, 332, 351 and 361 to allow the item 300 to transform into the first form in which the item 300 is folded and into the second form in which the item 300 is unfolded.

That is, the item 300 includes the item head 320 rotatably disposed on the upper portion of the item body 310 by means of the first item hinge 311, the first item wings 330 rotatably disposed on both sides of the item body 310 by means of the second item hinges 331, the second item wings 340 rotatably disposed on the ends of the first item wings 330 by means of the third item hinges 332, the item legs 350 rotatably disposed on both sides of the lower portion of the item body 310 by means of the fourth item hinges 351, and the item tail 360 rotatably disposed on the rear side of the lower portion of the item body 310 by means of the fifth item hinge 361.

Further, the fourth springs 331*a* are mounted on the first to fifth item hinges 311, 331, 332, 351 and 361 to provide the elastic forces to the rotary members.

The item locking part 370 is located on the item body 310 in such a manner as to allow one side thereof to protrude outwardly from the item body 310 and the other side thereof to be locked onto item locking protrusions 330*a* formed on the first item wings 330 through item locking part locking protrusions 370*a*, and further, the item locking part 370 includes a fifth spring 371 adapted to provide an elastic force to allow the locked state between the item locking part locking protrusions 370*a* and the item locking protrusions 330*a* to be maintained.

Next, an explanation on the operation process of the transforming toy according to the first embodiment of the present invention will be given.

First, if the item head 320, the first item wings 330, the second item wings 340, the item legs 350 and the item tail 360 of the item 300 are folded around the item body 310, the item locking part locking protrusions 370*a* and the item locking protrusions 330*a* are locked onto each other to provide the item 300 having the first form.

The item 300 having the first form is mounted in the throwing part 130 of the lower housing 120 of the transforming toy 100 having the second form in which the first housing 110' of the upper housing 110 is open, and the first housing 110' rotates in a counterclockwise direction on the drawing.

If the first housing 110' rotates, the returning means 150 connected to the lever 116 pulls, and the throwing part 130 connected to the other end of the returning means 150 rotates in a clockwise direction on the drawing.

If the first housing 110' rotates more, the auxiliary lever 118 comes into contact with the top surface of the throwing part 130 to allow the throwing part 130 to completely rotate, and then, the throwing part 130 is fixed by means of the second latch 141' of the latch part 140.

On the other hand, if the first housing 110' completely rotates, the slide member latch 163' of the locking part 160 is inserted into the locking slot 122 of the lower housing 120 so that the locking part 160 becomes in a locked state, thereby allowing the transforming toy 100 to be maintained to the first form.

After that, if the transforming toy 100 is driven to allow the lock releasing means 200 located at a given position to be disposed thereunder, a magnetic field is formed between the magnetic material disposed inside the lock releasing means 200 and the magnet 165 located at the locking part 160 to generate mutual attraction therebetween.

The locking part body 161 moves downwardly on the drawing by means of the magnetic force generated between the lock releasing means 200 and the magnet 165, thereby allowing the slide member 163 to move horizontally.

If the slide member 163 moves horizontally, the slide member latch 163' of the slide member 163 is separated from the locking slot 122 and is thus released from the locked state thereof. Further, the first housing 110' of the upper housing 110 rotates in the clockwise direction on the drawing around the rotary shafts 113 by means of the elastic forces of the springs 114, thereby allowing the transforming toy 100 to transform into the second form from the first form.

If the first housing 110' rotates upwardly and is thus open, the lever 116 pressurizes the first latch 141' of the latch part 140 while being rotated around the rotary shafts 113, thereby allowing the latch part 140 to be operated.

If the second latch 141" is released from the locked state thereof by means of the operation of the latch part 140, the throwing part 130 rotates around the rotary shaft 126 by means of the elastic force of the spring 127, and if the rotation is finished within a given range, the item 300 accommodated in the throwing part 130 is thrown forwardly by means of an inertial force.

The forwardly thrown item 300 falls down, and through the pressurization of the item locking part 370 or the application of an impact to the item locking part 370, the item locking part locking protrusions 370*a* and the item locking protrusions 330*a* are released from their locked state, thereby allowing the item 300 having the first form to transform into that having the second form.

If the lock releasing means 200 is attached to the transforming toy having the first form, accordingly, the transforming toy transforms into the second form, and the item accommodated into the transforming toy is thrown to the outside, thereby increasing the excitement in the game.

Further, the item 300 also transforms into the second form from the first form, thereby more increasing the excitement in the game.

(Second Embodiment)

FIG. 11 is an exploded perspective view showing the configuration of a transforming toy according to a second embodiment of the present invention, FIG. 12 is a sectional view showing an operating process of the transforming toy according to the second embodiment of the present invention, and FIGS. 13*a* to 13*d* are perspective views showing other operating processes of the transforming toy according to the second embodiment of the present invention.

As shown in FIGS. 11 to 13*d*, a transforming toy 100*a* according to a second embodiment of the present invention includes an upper housing 110*a*, a lower housing 120*a*, a pressurizing part 130*a*, a first locking part 140*a*, a second locking part 150*a*, a discharging part 160*a*, lock releasing means 200, and an item 300, wherein the first and second locking parts 140*a* and 150*a* maintain the transforming toy 100*a* to a first form in their locked state to allow the item 300 accommodated in the transforming toy 100*a* to be fixed to the transforming toy 100*a*, and if the first and second locking parts 140*a* and 150*a* are released from their locked state through the attachment to the lock releasing means 200, the transforming toy 100*a* transforms into a second form from the first form to allow the item 300 accommodated in the transforming toy 100*a* to be released from the fixed state so that the item 300 is discharged to the outside.

The upper housing 110*a* forms the outer shape of the transforming toy 100*a* and has an accommodation space formed at the inside thereof. The transforming toy 100*a* has a variety of outer shapes like a given animation character, animal, or known car model, and includes a plurality of wheels freely rotating or operating cooperatively with driving means providing a driving force.

The lower housing 120*a* is located under the upper housing 110*a* to form an accommodation space in which the item 300 is accommodated and includes a lower housing body 121*a* adapted to locate an accommodation portion 122*a*, the pressurizing part 130*a*, the first locking part 140*a*, the second locking part 150*a*, and the discharging part 160*a* thereon.

Further, the lower housing 120*a* has a magnet through hole 121*a* formed on one side thereof in such a manner as to pass a magnet 154 of the second locking part 150*a* therethrough, so that the second locking part 150*a* can be attached well to the lock releasing means 200.

The lower housing body 121 is a plate-shaped member and includes the accommodation portion 122*a*, wheel installation grooves 123*a* into which wheels are located, a pair of second locking part guides 124*a* adapted to locate the second locking part 150*a* thereon, first locking part hinges 125*a* adapted to locate the first locking part 140*a* thereon, and a pressurizing part through hole 126*a*.

The accommodation portion 122*a* is a member having an open portion formed on one side thereof and accommodates the item 300 in the interior thereof. The item 300 is any one selected from a card having at least one of a doll, character, text, numbers, figure, and pattern printed on one surface or both surfaces thereof, a doll, and a character.

The pressurizing part 130*a* is a plate-shaped member adapted to cover the accommodation portion 122*a* of the lower housing 120*a* in such a manner as to be rotatably coupled to a pressurizing part hinge 110*a*' formed on the lower portion of the upper housing 110*a* through a pressurizing part rotary shaft 131*a* and to pressurize a floor through the elastic forces of first springs 132*a* in such a manner as to allow the upper housing 110*a* and the lower housing 120*a* to transform into the second form from the first form.

Further, the pressurizing part 130*a* includes the first spring 132*a* rotating around the pressurizing part hinges 110*a*' and providing the elastic forces to pressurize the floor thereagainst if the pressurizing part 130*a* is released from the locked state onto the lower housing 120*a* and is thus separated from the lower housing 120*a*, a locking slot 133*a* locked onto the second locking part 150*a* to maintain a locking state wherein the pressurizing part 130*a* comes into close contact with the underside of the lower housing 120*a*, and a pressurizing part latch 134*a* extended by a given length from the pressurizing part rotary shaft 131*a* to pressurize a first locking part latch 143*a* thereagainst at a rotation position of the pressurizing part 130*a* if the pressurizing part 130*a* rotates.

If the second locking part 150*a* is separated from the locking slot 133*a* and is thus released from the locked state, further, the pressurizing part 130*a* pressurizes the floor thereagainst through the elastic forces of the first springs 132*a* to allow the first housing 110*a* and the second housing 120*a* having the first form to be turned over, so that they transform into the second form.

If the first housing 110*a* and the second housing 120*a* are turned over to have the second form, further, the open portion of the accommodation portion 122*a* is open to discharge the item 300 from the accommodation portion 122*a*.

The first locking part 140*a* is located on one side of the lower housing 120*a* in such a manner as to be movable in accordance with the rotation positions of the pressurizing part 130*a* to allow the discharging part 160*a* to be locked or released from the locked state. The first locking part 140*a* includes a first locking part rotary shaft 141*a* rotatably coupled to the first locking part hinges 125*a* of the lower housing 120*a*, a first locking part locking protrusion 142*a* extended by a given length from one side of the first locking part rotary shaft 141*a*, the first locking part latch 143*a* extended by a given length from the other side of the first locking part rotary shaft 141*a* in such a manner as to be pressurized to allow the first locking part locking protrusion 142*a* to rotate around the first locking part rotary shaft 141*a*, and a first locking part spring 144*a* adapted to maintain the locked state wherein the first locking part locking protrusion 142*a* is locked onto the discharging part 160*a* and to provide an elastic force to allow the first locking part protrusion 142*a* to be returned to its original position if the locked state onto the discharging part 160*a* is released.

According to the second embodiment of the present invention, the first locking part 140*a* is rotated and changed in position around the first locking part rotary shaft 141*a* according to the rotation of the pressurizing part 130*a*, but it is not limited thereto. That is, of course, the first locking part 140*a* is slidingly movable to one side according to the rotation of the pressurizing part 130*a* and is thus slidingly changed in position.

The second locking part 150*a* is located on the lower housing 120*a* in such a manner as to fix the pressurizing part 130*a* thereto and is attached to the lock releasing means 200 by means of a magnetic force or is changed to a lock releasing position through the physical contact with the lock releasing means 200 to allow the pressuring part 130*a* to rotate. The second locking part 150*a* includes a second locking part body 151*a*, a slide member 152*a*, a second locking part protrusion 153*a*, second locking part slant portions 154*a*, slide member slant portions 155*a*, a slide member latch 156*a*, a slide member spring 157*a*, and a magnet 158*a*.

The second locking part body 151*a* moves upwardly and downwardly along long through holes 124*a*' formed along the longitudinal directions of the second locking part guides

124*a* of the lower housing body 120*a* and includes the second locking part protrusion 153*a* and the second locking part slant portions 154*a*.

The second locking part protrusion 153*a* protrudes by a given length from the second locking part body 151*a* in such a manner as to be inserted into the through holes 124*a*' to allow the second locking part body 151*a* to move along the second locking part guides 124*a*.

The second locking part slant portions 154*a* are formed on both side walls of the second locking part body 151*a* and are locked onto the slide member 152*a* if the second locking part body 151*a* moves downwardly to pressurize the slide member 152*a* so that the slide member 152*a* moves in a horizontal direction. Further, the second locking part slant portions 154*a* have slant surfaces 154*a*' formed on the portions coming into contact with the slide member 152*a*.

The slide member 152*a* includes the slide member slant portions 155*a*, the slide member latch 156, and the slide member spring 157*a*, so that one side of the slide member 152*a* is locked onto the second locking part body 151*a*, while the other side thereof is being locked onto the locking slot 133*a* of the pressurizing part 130*a*, and the slide member 152*a* moves horizontally in accordance with the upward and downward movements of the second locking part body 151*a* to allow the pressurizing part 130*a* to be maintained to the locked state or released from the locked state.

The slide member slant portions 155*a* protrude upwardly from one side of the slide member 152*a* in such a manner as to be locked onto the second locking part body 151*a*, and desirably, include slant surfaces 155*a*' formed on tops thereof in such a manner as to come into close contact with the second locking part slant portions 154*a* of the second locking part body 151*a*.

The slide member latch 156*a* is a bar-shaped member extended by a given length from the other side of the slide member slant portions 155*a* and has an end portion inserted into the locking slot 133*a* to allow the pressurizing part 130*a* to be maintained to the locked state. If the end portion of the slide member latch 156*a* is separated from the locking slot 133*a*, the locked state of the pressurizing part 130*a* is released.

Further, the end portion of the slide member latch 156*a* is tapered so that it can be easily inserted or separated into or from the locking slot 133*a*.

The slide member spring 157*a* is located between the slide member latch 156*a* and the second locking part guides 124*a* to provide an elastic force so that the slide member 152*a* is maintained at a given position on one side of the second locking part body 151*a*.

That is, if the second locking part body 151*a* moves downwardly to allow the slide member 152*a* to move, for example, to the left direction in FIG. 12, the slide member spring 157*a* is compressed, and if a force generated in a downward direction disappears from the second locking part body 151*a*, the slide member 152*a* move to the right direction in FIG. 12 and is thus returned to its original position by means of the compressed elastic force of the slide member spring 157*a*, so that the second locking part body 151*a* moves to the upward direction and is thus returned to its original position.

The magnet 158*a* is located on the underside of the second locking part body 151*a* in such a manner as to be attached to the lock releasing means 200, and desirably, the magnet 158*a* is a neodymium magnet. The magnet 158*a* is attached to a magnetic material or metal plate disposed on the lock releasing means 200 through a magnetic field to allow the second locking part body 151*a* to move downwardly.

According to the second embodiment of the present invention, the second locking part 150*a* is changed to the lock releasing position by means of the magnetic force attachment to the lock releasing means 200, but it is not limited thereto. Like an eighth embodiment of the present invention as will be discussed later, the second locking part protrudes downwardly by a given length from the upper housing, and the pressurizing part 130*a* is separated from the lower housing to allow the second locking part 150*a* to be changed to the lock releasing position by means of the physical contact with the lock releasing means, thereby permitting the upper housing and the lower housing to transform into the second form.

The discharging part 160*a* is disposed in the accommodation space of the lower housing 120*a*, and if the upper housing 110*a* and the lower housing 120*a* are turned over by means of the pressurizing part 130*a* and thus transform into the second form, the discharging part 160*a* is released from the locked state onto the first locking part 140*a* to pressurize the item 300, so that the item 300 is discharged to the outside. The discharging part 160*a* includes a discharging part spring 161*a* adapted to pressurize the plate-shaped discharging part 160*a* to discharge the item 300 accommodated in the accommodation portion 122*a* if the pressurizing part 130*a* is released from the locked state to allow the open portion of the accommodation portion 122*a* to be open.

That is, the discharging part 160*a* is locked onto the first locking part locking protrusion 142*a* on one side thereof to maintain the locked state at a given inner position of the accommodation portion 122*a*, and if it is released from the locked state onto the first locking part locking protrusion 142*a*, it moves upwardly and downwardly in the interior of the accommodation portion 122*a* by means of the elastic force of the discharging part spring 161*a*.

Next, an explanation on the operation process of the transforming toy 100*a* according to the second embodiment of the present invention will be given.

In the state where the transforming toy 100*a* is turned over, one side of the pressurizing part 130*a* is separated from the underside of the transforming toy 100*a*, and the pressurizing part 130*a* rotates around the rotary shaft 131*a*. After that, the open portion of the accommodation portion 122*a* is open to accommodate the item 300 in the accommodation portion 122*a*.

At this time, if the discharging part 160*a* disposed on the accommodation portion 122*a* is pressed to move until it is locked onto the first locking part locking protrusion 142*a* to cause a locked state, the discharging part spring 161*a* is in a pressurized state.

If the accommodation of the item 300 in the accommodation portion 122*a* is finished through the locked state of the discharging part 160*a*, the pressurizing part 130*a* rotates to come into close contact with the underside of the lower housing 120*a* to allow the open portion of the accommodation portion 122 to be closed.

If the pressurizing part 130*a* comes into close contact with the underside of the lower housing 120*a*, the locking slot 133*a* of the pressurizing part 130*a* is locked onto the slide member latch 156*a* to allow the pressurizing part 130*a* to be in a locked state, so that the pressurizing part 130*a* is maintained at the fixed state to the underside of the lower housing 120*a*.

If the fixation of the pressurizing part 130*a* is finished, the transforming toy 100*a* is located normally on the floor, and it is driven by a user in a direction of the lock releasing means 200 disposed on the opposite side thereto.

If the transforming toy 100*a* passes through the top surface of the lock releasing means 200, while being driven, the magnet 158*a* located on the underside of the transforming toy 100*a* is attached to the lock releasing means 200.

The magnetic material or metal plate disposed in the interior of the lock releasing means 200 is attached to the magnet 158*a* through the attraction caused by the magnetic field of the magnet 158*a*, and through the attachment of the lock releasing means 200 to the magnet 158*a*, the second locking part body 151*a* moves downwardly. Through the movement of the second locking part body 151*a*, the slide member 152*a* moves horizontally to release the locked state of the pressurizing portion 130*a*.

If the slide member 152*a* moves to allow the locked state of the pressurizing portion 130*a* to be released, further, the pressurizing part 130*a* separated from the lower portion of the transforming toy 100*a* rotates by means of the elastic forces of the first springs 132*a* and pressurizes the floor thereagainst.

If the pressurizing part 130*a* rotates by about 90° by means of the first springs 132*a*, the transforming toy 100*a* is erected up, and if the pressurizing part 130*a* rotates by about 90° or more, the transforming toy 100*a* is completely turned over.

On the other hand, if the pressurizing part latch 134*a* rotates to pressurize the end of the first locking part latch 143*a*, the first locking part latch 143*a* rotates around the first locking part rotary shaft 141*a* to allow the first locking part locking protrusion 142*a* to rotate upwardly, so that the first locking part 140*a* is separated from the discharging part 160*a* to release the locked state of the discharging part 160*a*.

If the discharging part 160*a* is released from its locked state, the top of the accommodation portion 122*a* is open to upwardly spring and discharge the item 300 accommodated in the accommodation portion 122*a* by means of the elastic force of the discharging part spring 161*a* being in a compressed state.

If the lock releasing means 200 is attached to the transforming toy 100*a* having the first form, accordingly, the transforming toy 100*a* transforms into the second form to discharge the item 300 accommodated therein to the outside, thereby more increasing the excitement in the game.

(Third Embodiment)

FIG. 14 is a perspective view showing a transforming toy according to a third embodiment of the present invention, FIG. 15 is an exploded perspective view showing the configuration of the transforming toy according to the third embodiment of the present invention, and FIG. 16 is a sectional view showing the configuration of the transforming toy according to the third embodiment of the present invention.

As shown in FIGS. 14 to 16, a transforming toy 100*b* according to a third embodiment of the present invention includes an upper housing 110*b*, a lower housing 120*b*, a pressurizing part 130*b*, a first locking part 140*b*, a second locking part 150*b*, and a discharging part 160*b*, wherein the first and second locking parts 140*b* and 150*b* maintain the transforming toy 100*b* to a first form in their locked state to allow the item 300 accommodated in the transforming toy 100*b* to be fixed to the transforming toy 100*b*, and if the first and second locking parts 140*b* and 150*b* are released from their locked state through the attachment to a given lock releasing means 200, the transforming toy 100*b* transforms into a second form from the first form to allow the item 300 accommodated in the transforming toy 100*b* to be released from the fixed state so that the item 300 is discharged to the outside.

The configuration of the transforming toy 100*b* according to the third embodiment of the present invention is different from that of the transforming toy 100*a* according to the second embodiment of the present invention in that a plurality of fenders 111*b* is disposed on the upper housing 110*b* and the second locking part 150*b* is differently configured from that of the transforming toy 100*a*.

The plurality of fenders 111*b* is rotatably disposed horizontally on both sides of the upper housing 110*b* having an accommodation space formed at the inside thereof, and if the second locking part 150*b* is operated and released from the locked state thereof, the plurality of fenders 111*b* is separated from the upper housing 110*b* to allow the pressurizing part 130*b* to be operated. The fenders 111*b* include fender through holes 112*b* formed on one side thereof in such a manner as to rotatably coupled to the lower housing 120*b* through fender hinges 127*b*, fender locking grooves 111*b*', and fender latches 111*b*".

Each fender through hole 112*b* is formed on one side of each fender 111*b* in a longitudinal direction thereof and is thus coupled to the corresponding fender hinge 127*b* of the lower housing 120*b* through a fender rotary shaft 113*b*. Through the elastic forces of fender springs 114*b*, further, the fenders 111*b* rotate around the lower housing 120*b* in left and right directions.

The fender locking grooves 111*b*' are portions formed on the other side of the fenders 111*b* and are thus locked onto second locking part latches 152*b* of the second locking part 150*b* to allow the fenders 111*b* to be fixed to the left/right sides of the upper housing 110*b*.

The fender latches 111*b*" protrude from one side of the fender through holes 112*b* in such a manner as to be locked onto locking slots 133*b* of the pressurizing part 130*b* to allow the pressurizing part 130*b* to be locked or released from the locked state.

Reference numerals 117*b* indicate front wheels of the transforming toys 100*b* which are disposed on the fenders 111*b* by means of rotary shafts 117*b*'.

The lower housing 120*b* is located under the upper housing 110*b* to form an accommodation space in which the item 300 is accommodated and includes a lower housing body 121*b* adapted to locate an accommodation portion 122*b*, the pressurizing part 130*b*, the first locking part 140*b*, the second locking part 150*b*, and the discharging part 160*b* thereon.

The lower housing body 121*b* is a plate-shaped member and includes the accommodation portion 122*b* in which the item 300 (See FIG. 11) is accommodated, wheel installation grooves 123*b* into which wheels are located, a pair of second locking part guides 124*b* adapted to locate the second locking part 150*b* thereon, first locking part hinges 125*b* adapted to locate the first locking part 140*b* thereon, a pressurizing part through hole 126*b*, and the fender hinges 127*b*.

The second locking part guides 124*b* protrude by given lengths from top of the lower housing body 121*b* to seat a second locking part body 151*b* thereon, so that the second locking part body 151*b* moves upwardly and downwardly along the second locking part guides 124*b*.

The fender hinges 127*b* protrude by given lengths from top of the lower housing 120*b* in such a manner as to face each other on both sides of the lower housing 120*b* to allow the fenders 111*b* to be rotatably coupled to the lower housing

120*b* by means of the fender through holes 112*b* and the fender rotary shafts 113*b*, so that upon lock releasing, the fenders 111*b* rotate.

The pressurizing part 130*b* is adapted to cover the accommodation portion 122*b* of the lower housing 120*b* in such a manner as to be rotatably disposed on the lower portion of the upper housing 110*b* by means of a pressurizing part hinge 131*b* and adapted to pressurize a floor through the elastic forces of springs 132*b* in such a manner as to allow the upper housing 110*b* and the lower housing 120*b* to transform into the second form from the first form.

Further, the pressurizing part 130*b* has the locking slots 133*b* formed on both ends of the other side thereof in such a manner as to be locked onto the fender latches 111*b*" of the fenders 111*b*, so that the pressurizing part 130*b* is fixedly supported against the fenders 111*b* or released from the locked state and thus separated from the fenders 111*b*.

The first locking part 140*b* is disposed on one side of the lower housing 120*b* in such a manner as to be movable according to the positions of the pressurizing part 130*b* to allow the discharging part 160*b* to be locked or released from the locked state.

The second locking part 150*b* is located on the lower housing 120*b* in such a manner as to fix the fenders 111*b* and the pressurizing part 130*b* to given positions thereof and is attached to the lock releasing means 200 by means of a magnetic force or is changed to a lock releasing position through the physical contact with the lock releasing means 200 to allow the fenders 111*b* and the pressuring part 130*b* to rotate. The second locking part 150*b* includes the second locking part body 151*b*, the second locking part latch 152*b*, a second locking part spring 153*b*, and a magnet 154*b*.

The second locking part body 151*b* moves upwardly and downwardly on the second locking part guides 124*b* of the lower housing body 120*b* and includes the second locking part latch 152*b* disposed on top thereof in such manner as to be locked onto the fender locking grooves 111*b*' of the fenders 111*b* to fix the fenders 111*b* thereto.

The second locking part latch 152*b* is locked onto or separated from the fenders 111*b* so that the locked state is maintained to allow the fenders 111*b* to be fixed to both sides of the front side of the upper housing 110*b* or the locked state is released through the separation of the fenders 111*b* from the upper housing 110*b*.

The second locking part spring 153*b* is located between the second locking part body 151*b* and the lower housing 120*b* to provide an elastic force so that the second locking part body 151*b* is maintained at a given position. That is, if the second locking part body 151*b* moves downwardly by means of the attachment of the magnet 154*b* to the lock releasing means 200, the second locking part spring 153*b* is compressed, and if the lock releasing means 200 is separated from the magnet 154*b*, the second locking part spring 153*b* provides the elastic force to allow the second locking part body 151*b* to move upwardly and be thus returned to its original position.

The magnet 154*b* is located on the underside of the second locking part body 151*b*, and if attraction caused by a magnetic field is applied to the magnet 154*b* so as to allow the magnet 154*b* to be attached to the lock releasing means 200, the magnet 154*b* moves the second locking part body 151*b* downwardly. Desirably, the magnet 154*b* is a neodymium magnet.

According to the third embodiment of the present invention, the second locking part 150*b* is changed to the lock releasing position by means of the magnetic force attachment to the lock releasing means 200, but it is not limited thereto. Like the eighth embodiment of the present invention as will be discussed later, the second locking part protrudes downwardly by a given length from the upper housing, and the pressurizing part 130*b* is separated from the lower housing to allow the second locking part 150*b* to be changed to the lock releasing position by means of the physical contact with the lock releasing means, thereby permitting the upper housing and the lower housing to transform into the second form.

The discharging part 160*b* is disposed in the accommodation space of the lower housing 120*b*, and if the upper housing 110*b* and the lower housing 120*b* are turned over by means of the pressurizing part 130*b* and thus transform into the second form, the discharging part 160*b* is released from the locked state onto the first locking part 140*b* to pressurize the item 300, so that the item 300 is discharged to the outside. The configuration of the discharging part 160*b* is the same as of the discharging part 160*a* according to the second embodiment of the present invention.

Next, an explanation on the operation process of the transforming toy according to the third embodiment of the present invention will be given.

In the state where the fenders 111*b* and the pressurizing part 130*b* are fixed, the transforming toy 100*b* is located on the floor, and after that, if the transforming toy 100*b* is driven in a direction of the lock releasing means 200 disposed on the opposite side thereto, the magnet 154*b* is attached to the lock releasing means 200, so that the second locking part 150*b* moves downwardly to allow the second locking part spring 153*b* to be compressed and to allow the second locking part latch 152*b* to be separated from the fender locking grooves 111*b*' of the fenders 111*b* and thus released from the locked state.

If the fenders 111*b* are released from the locked states, the fenders 111*b* rotate to open in left and right directions around the fender hinges 127*b*, and accordingly, the fender latches 111*b*" of the fenders 111*b* are separated from the locking slots 133*b* of the pressurizing part 130*b*, so that the pressurizing part 130*b* is also released from the locked state.

If the pressurizing part 130*b* is released from the locked state, the pressurizing part 130*b* separated from the lower portion of the transforming toy 100*b* rotates to pressurize the floor by means of the elastic forces of the springs 132*b*.

If the lock releasing means 200 is attached to the transforming toy 100*b* having the first form, accordingly, the transforming toy 100*b* transforms into the second form to discharge the item 300 accommodated therein to the outside, thereby more increasing the excitement in the game.

(Fourth Embodiment)

FIG. 17 is an exploded perspective view showing the configuration of a transforming toy according to a fourth embodiment of the present invention, FIG. 18 is a perspective view showing an operating process of the transforming toy according to the fourth embodiment of the present invention, FIG. 19 is a sectional view showing another operating process of the transforming toy according to the fourth embodiment of the present invention, FIG. 20 is a sectional view showing yet another operating process of the transforming toy according to the fourth embodiment of the present invention, and FIG. 21 is a sectional view showing still another operating process of the transforming toy according to the fourth embodiment of the present invention.

As shown in FIGS. 17 to 21, a transforming toy 100*c* according to a fourth embodiment of the present invention includes a housing 110*c*, a pressurizing part 120*c*, a throwing part 140*c*, and a locking part 160*c*, wherein the locking part 160*c* maintains the transforming toy 100*c* to a first form in a locked state to allow an item 300 accommodated in the transforming toy 100*c* to be fixed to the transforming toy 100*c*, and if the locking part 160*c* is released from the locked state thereof through the attachment to given lock releasing means 200, the transforming toy 100*c* transforms into a second form from the first form to allow the item 300 accommodated therein to be released from the fixed state so that the item 300 is discharged to the outside.

The housing 110*c* forms the outer shape of the transforming toy 100*c* and includes a first accommodation portion 111*c* in which the item 300 is accommodated and a second accommodation portion 112*c* in which the locking part 160*c* is located, as an accommodation space formed at the inside thereof. Further, the housing 110*c* includes a housing hinge 114*c* located on one side of the underside thereof in such a manner as to allow the pressurizing part 120*c* to be rotatably coupled thereto and a housing latch 115*c* extended by a given length from the housing hinge 114*c*.

The first accommodation portion 111*c* and the second accommodation portion 112*c* are separated from each other, and a through hole 113*c* is formed between the first accommodation portion 111*c* and the second accommodation portion 112*c*.

The housing latch 115*c* protrudes from the housing hinge 114*c* in such a manner as to pressurize one side surface of the throwing part 140*c* to allow the throwing part 140*c* to be maintained to the locked state. If the pressurizing part 120*c* is separated from the housing 110*c*, the housing latch 115*c* maintains the locked state of the throwing part 140*c* so as to prevent the throwing part 140*c* from rotating until the pressurizing part 120*c* reaches a given rotation position, and if the pressurizing part 120*c* reaches the given rotation position, the throwing part 140*c* is released from the locked state.

If the pressurizing part 120*c* is separated from the housing 110*c* and rotates, the housing latch 115*c* is adapted to allow the throwing part 140*c* to rotate after a given period of time passes.

The housing 110*c* has a variety of outer shapes like a given animation character, animal, or known car model, and includes a plurality of wheels freely rotating or operating cooperatively with driving means (not shown) providing a driving force like a spring, a motor and so on.

The pressurizing part 120*c* is a plate-shaped member that is rotatably coupled to the housing hinge 114*c* located on the underside of the housing 110*c* by means of a first rotary shaft 130*c* and pressurizes a floor through the elastic force of a first spring 131*c* mounted on the first rotary shaft 130*c* to allow the housing 110*c* to be erected up or turned over, so that the housing 110*c* transforms into the second form from the first form. The pressurizing part 120*c* includes first pressurizing part hinges 121*c*, a second pressurizing part hinge 122*c*, a pressurizing part locking slot 123*c*, and item supports 124*c*.

The first pressurizing part hinges 121*c* are located on one side of the plate-shaped pressurizing part 120*c* to allow the pressurizing part 120*c* to be rotatably coupled to the housing 110*c* by means of the housing hinge 114*c* and the first rotary shaft 130*c*.

Further, the first spring 131*c* is located on the first pressurizing part hinges 121*c* to provide an elastic force between the housing 110*c* and the pressurizing part 120*c*.

The second pressurizing part hinge 122*c* is located on the other side of the pressurizing part 120*c* to allow the throwing part 140*c* to be rotatably coupled to the pressurizing part 120*c* by means of a second shaft 151*c*.

Further, the second spring 151*c* is located on the second pressurizing part hinge 122*c* to provide an elastic force between the pressurizing part 120*c* and the throwing part 140*c*.

The pressurizing part locking slot 123*c* is formed on the second pressurizing part hinge 122*c* in such a manner as to be locked onto the locking part 160*c* to allow the pressurizing part 120*c* to be fixedly located on the underside of the housing 110*c*.

The item supports 124*c* are located on both sides of the pressurizing part 120*c* in a longitudinal direction in such a manner as to come into close contact with both sides of the item 300 accommodated in the throwing part 140*c* to prevent the item 300 from moving, and each item support 124*c* includes at least one locking protrusion 125*c* formed on the inside thereof in such a manner as to come into contact with the item 300.

The throwing part 140*c* is a plate-shaped member that is rotatably coupled to the pressurizing part 120*c* by means of the second pressurizing part hinge 122*c* and the second rotary shaft 150*c* and pressurizes the pressurizing part 120*c* and the item 300 by means of the elastic force of the second spring 151*c* mounted on the second rotary shaft 150*c* to allow the item 300 to be thrown to the outside of the housing 110*c*. The throwing part 140*c* includes throwing part hinges 141*c* and curved portions 142*c*.

The throwing part hinges 141*c* are located on one side of the plate-shaped throwing part 140*c* in such a manner as to allow the throwing part 140*c* to be rotatably coupled to the second pressurizing part hinge 122*c* by means of the second rotary shaft 150*c*.

The curved portions 142*c* are curvedly formed inwardly from both sides of the body of the throwing part 140*c* in such a manner as to pass the item supports 124*c* located on both sides of the pressurizing part 120*c* through the throwing part 140*c* to allow the item 300 disposed on the throwing part 140*c* to be supported thereagainst.

The locking part 160*c* is located in the second accommodation portion 112*c* of the housing 110*c* and is attached to the lock releasing means 200 by means of a magnetic force or is changed to a lock releasing position through the physical contact with the lock releasing means 200 to allow the pressuring part 120*c* being in a locked state, wherein the pressurizing part 120*c* is maintained to a given position on the underside of the housing 110*c*, to rotate and to be thus released from the locked state. The locking part 160*c* includes a locking part body 161*c*, a slide member 163*c*, a magnet 165*c*, and a spring 166*c*.

The locking part body 161*c* is a square-shaped member that moves and changed in position in upward and downward directions of the second accommodation portion 112*c* if the lock releasing means 200 and the magnet 165*c* are attached to each other, and includes a locking part protrusion 161*c*' and locking part slant surfaces 162*c*.

The locking part protrusion 161*c*' protrudes by a given length from the locking part body 161*c* in such a manner as to be locked onto guides 116*c* of the second accommodation portion 112*c* to allow the locking part body 161*c* to move upwardly and downwardly.

The locking part slant surfaces 162*c* are formed on both side walls of the locking part body 161*c* and are locked onto with slant surfaces 164*c* of the slide member 163*c*, so that if the locking part body 161*c* moves downwardly, the locking part slant surfaces 162*c* pressurize the slide member 163*c* to allow the slide member 163*c* to move in a horizontal direction.

The slide member 163*c* includes the slide member slant surfaces 164*c* formed on one side thereof in such manner as to be locked onto the locking part slant surfaces 162*c* of the locking part body 161*c* and a slide member latch 163*c*' located on the other side thereof in such a manner as to be locked onto the pressurizing part locking slot 123*c* of the pressurizing part 120*c*, so that the slide member 163*c* moves horizontally in accordance with the upward and downward movements of the locking part body 161*c* to allow the pressurizing part 120*c* to be locked or released from the locked state.

The slide member latch 163*c*' passes through the through hole 113*c* formed between the first accommodation portion 111*c* and the second accommodation portion 112*c* and is thus locked onto the pressurizing part locking slot 123*c*.

The magnet 165*c* is located on the underside of the locking part body 161*c* and forms a magnetic field together with the lock releasing means 200 to provide a driving force so that the locking part body 161*c* moves upwardly and downwardly.

The spring 166*c* provides an elastic force to allow the slide member 163*c* to be maintained at a given position (for example, a position wherein the pressurizing part 120*c* is maintained to the locked state). If the locking part body 161*c* moves downwardly by means of the magnetic field of the magnet 165*c*, the spring 166*c* is compressed by means of the slide member 163*c*, and if the magnetic field formed by the magnet 165*c* disappears, the spring 166*c* is expanded to allow the locking part body 161*c* and the slide member 163*c* to be returned to their original position.

According to the fifth embodiment of the present invention, the locking part 160*c* is changed to the lock releasing position by means of the magnetic force attachment to the lock releasing means 200, but it is not limited thereto. Like the eighth embodiment of the present invention as will be discussed later, the locking part 160*c* protrudes downwardly by a given length from the housing, and the pressurizing part 130*a* is separated from the housing to allow the locking part 160*c* to be changed to the lock releasing position by means of the physical contact with the lock releasing means 200, thereby permitting the housing to transform into the second form.

Next, an explanation on the operation process of the transforming toy according to the fourth embodiment of the present invention will be given.

First, the item 300 is located on top of the throwing part 140*c* foldable to the pressurizing part 120*c* in such a manner as to be supported against the item supports 124*c*, and next, the item 300 is inserted into the first accommodation portion 111*c* of the housing 110*c*.

At this time, the slide member latch 163*c*' of the locking part 160*c* protrudes from the through hole 113*c*, and it is locked onto the pressurizing part locking slot 123*c* of the pressurizing part 120*c* moved to the underside of the first accommodation portion 111*c*, so that the item 300 is maintained at the accommodated state in the interior of the housing 110*c*.

After that, if the transforming toy 100*c* is driven to allow the lock releasing means 200 located at a given position to be disposed thereunder, a magnetic field is formed between the magnetic material disposed inside the lock releasing means 200 and the magnet 165*c* located at the locking part 160*c* to generate mutual attraction therebetween.

The locking part body 161*c* moves downwardly on the drawing by means of the magnetic force generated between the lock releasing means 200 and the magnet 165*c*, thereby allowing the slide member 163*c* to move horizontally.

If the slide member 163*c* moves horizontally, the slide member latch 163*c*' of the slide member 163*c* is separated from the locking slot 123*c* of the pressurizing part 120*c* and is thus released from the locked state. Further, the pressurizing part 120*c* pressurizes the floor by means of the elastic force of the first spring 131*c* to allow the housing 110*c* to rotate upwardly, so that the transforming toy 100*c* is erected or completely turned over in such a manner as to transform into the second form from the first form.

If the housing 110*c* rotates upwardly and is thus open, the housing latch 115*c* pressurizing the throwing part 140*c* also rotates upwardly, and if the housing 110*c* is over a given rotation range, the housing latch 115*c* is separated from the throwing part 140*c* to allow the throwing part 140*c* to throw the item 300 forwardly by means of the elastic force of the second spring 151*c*.

If the lock releasing means 200 is attached to the transforming toy 100*c* having the first form, accordingly, the transforming toy 100*c* transforms into the second form, and the item 300 accommodated into the transforming toy 100*c* is thrown to the outside, thereby increasing the excitement in the game.

(Fifth Embodiment)

FIG. 22 is a perspective view showing a transforming toy according to a fifth embodiment of the present invention, FIG. 23 is a sectional view showing the structure of an item of the transforming toy according to the fifth embodiment of the present invention, and FIG. 24 is a sectional view showing an operating process of the transforming toy according to the fifth embodiment of the present invention.

As shown in FIGS. 22 to 24, a transforming toy 100*d* according to a fifth embodiment of the present invention has the same configuration as the transforming toy 100*c* according to the fourth embodiment of the present invention, except that a throwing part 140*d* and an item 300' are partially differently configured from those of the transforming toy 100*c*. Accordingly, an explanation on the different configurations of the transforming toy 100*d* according to the fifth embodiment of the present invention will be given, and the repeated explanation on the same components as the transforming toy 100*c* will be avoided for the brevity of the description.

The throwing part 140*d* is a plate-shaped member that is rotatably coupled to the pressurizing part 120*c* by means of the second pressurizing part hinge 122*c* and the second rotary shaft 150*c* (See FIG. 17) and pressurizes the pressurizing part 120*c* and the item 300' by means of the elastic force of the second spring 151*c* (See FIG. 17) mounted on the second rotary shaft 150*c* to allow the item 300' to be thrown to the outside of the housing 110*c*. The throwing part 140*d* includes throwing part hinges 141*d* and a throwing part magnetic material 143*d*.

The throwing part magnetic material 143*d* is embedded in the throwing part 140*d* or located on the surface of the throwing part 140*d* to generate a magnetic field so that an item locking part 370' disposed on the item 300' is maintained to a locked state.

According to the fifth embodiment of the present invention, the item 300' has the item locking part 370', which is different from the item 300 according to the first embodiment of the present invention.

The item locking part 370' is disposed on an item body 310 and is locked onto item locking protrusions 330*a*' formed on first item wings 330' by means of item locking part locking protrusions 370*a*' formed on one side thereof. The item locking part locking protrusions 370*a*' and the item locking protrusions 330*a*' are locked onto each other by means of a magnetic force formed between an item magnet 380' and the throwing part magnetic material 143*d* disposed on the throwing part 140*d*.

If the item 300' is separated from the throwing part 140*d* and is thrown, the magnetic field between the item magnet 380' and the throwing part magnetic material 143*d* disappears, and a fifth spring 371' expanded becomes compressed. Accordingly, the item locking part locking protrusions 370*a*' are moved and separated from the item locking protrusions 330*a*', thereby releasing the locked state of the item locking part 370'.

If the item 300' is separated from the throwing part 140*d* and is thrown, accordingly, the item 300' transforms into the second form from the first form.

(Sixth Embodiment)

FIG. 25 is a perspective view showing a transforming toy according to a sixth embodiment of the present invention, FIG. 26 is a sectional view showing the structure of an item of the transforming toy according to the sixth embodiment of the present invention, and FIG. 27 is a sectional view showing an operating process of the transforming toy according to the sixth embodiment of the present invention.

As shown in FIGS. 25 to 27, a transforming toy 100*e* according to a sixth embodiment of the present invention has a pressurizing part 120*e*, a throwing part 140*e* and an item 300" differently configured from those of the transforming toy 100*c* according to the fourth embodiment of the present invention.

The pressurizing part 120*e* has a protrusion 126*e* extended by a given length from top thereof in such a manner as to be coupled to the item 300" to allow the item 300" to be maintained to the first form, that is, to the locked state, and if the protrusion 126*e* is separated from the item 300", the locked state is released to allow the item 300" to transform into the second form.

The throwing part 140*e* has a throwing part through hole 144*e* penetrated into the body thereof to pass the protrusion 126*e* of the pressurizing part 120*e* therethrough, so that the protrusion 126*e* is locked onto the item 300".

The item 300" includes an item body, a plurality of rotary members such as first item wings 330" foldable to the item body by means of a plurality of item hinges 331", fourth springs 331*a*" providing elastic forces so that the rotary members are unfolded around the item hinges 331", and coupling holes 330*a*" formed having a concentric axis on a given position of a portion where the first item wings 330" are overlapped with each other.

The coupling holes 330*a*" are coupled to the protrusion 126*e* of the pressurizing part 120*e* to allow the item 300" to be maintained to the first form as the locked state thereof, and if the coupling holes 330*a*" are separated from the protrusion 126*e*, the locked state of the item 300" is released to allow the item 300" to transform into the second form by means of the elastic forces of the fourth springs 331*a*".

If the item 300" is separated from the throwing part 140*e* and is thrown, accordingly, the item 300" transforms into the second form from the first form.

(Seventh Embodiment)

FIG. 28 is a perspective view showing a transforming toy according to a seventh embodiment of the present invention, FIG. 29 is a sectional view showing the structure of an item of the transforming toy according to the seventh embodiment of the present invention, and FIG. 30 is a sectional view showing an operating process of the transforming toy according to the seventh embodiment of the present invention.

As shown in FIGS. 28 to 30, a transforming toy 100*f* according to a seventh embodiment of the present invention has a throwing part 140*f* differently configured from that of the transforming toy 100*c* according to the fourth embodiment of the present invention.

The throwing part 140*f* has a throwing part protrusion 145*f* protruding from top thereof to pressurize the item locking part 370, so that if the item 300 is separated from the pressurizing part 120*c*, it can transform into the second form from the first form.

That is, if the pressurizing part 120*c*, the throwing part 140*f*, and the item 300 are accommodated in the interior of the housing 110*c*, the item 300 is fixed to a position spaced apart from the throwing part 140*f* by a given distance by means of the item supports 124*c* and the locking protrusions 125*c* of the pressurizing part 120*c*, and the pressurizing part 120*c* and the throwing part 140*f* are fixed by means of the housing latch 115*c* and the locking part 160*c*.

After that, if the transforming toy 100*f* is driven to allow the lock releasing means 200 located at a given position to be disposed thereunder, a magnetic field is formed between the magnetic material disposed inside the lock releasing means 200 and the magnet 165*c* located at the locking part 160*c* to generate mutual attraction therebetween, so that the locking part body 161*c* moves downwardly on the drawing to allow the slide member 163*c* to move horizontally.

If the slide member 163*c* moves horizontally, the slide member latch of the slide member 163*c* is separated from the locking slot 123*c* of the pressurizing part 120*c* and is thus released from the locked state. Further, the pressurizing part 120*c* pressurizes the floor by means of the elastic force of the first spring to allow the housing 110*c* to rotate upwardly, so that the transforming toy 100*f* transforms into the second form from the first form in such a manner as to be erected up or completely turned over.

At this time, the housing latch 115*c* pressurizing the throwing part 140*f* also rotates upwardly, and if the housing 110*c* is over a given rotation range, the housing latch 115*c* is separated from the throwing part 140*f* to allow the throwing part 140*f* to rotate by means of the elastic force of the second spring, so that the throwing part 140*f* hits the item locking part 370 and at the same time separates the item 300 from the item supports 124*c* and the locking protrusions 125*c* of the pressurizing part 120*c* to throw the item 300 forwardly.

According to the seventh embodiment of the present invention, if the item 300 is separated from the throwing part 140*f* and is thrown, the item 300 transforms into the second form from the first form.

(Eighth Embodiment)

FIG. 31 is an exploded perspective view showing a transforming toy according to an eighth embodiment of the present invention, FIG. 32 is a sectional view showing an operating process of the transforming toy according to the eighth embodiment of the present invention, FIG. 33 is a sectional view showing another operating process of the transforming toy according to the eighth embodiment of the present invention, and FIG. 34 is a perspective view showing the operating process of the transforming toy according to the eighth embodiment of the present invention.

As shown in FIGS. 31 to 34, a transforming toy 100*g* according to an eighth embodiment of the present invention includes an upper housing 110, a lower housing 120, a throwing part 130, a latch part 140, returning means 150, a locking part 160*g*, a magnet 170*g*, lock releasing means 200, and an item 300, wherein the locking part 160*g* maintains the transforming toy 100*g* to a first form in a locked state to allow the item 300 accommodated in the transforming toy 100*g* to be fixed to the transforming toy 100*g*, and if the locking part 160*g* is released from the locked state through the attachment to the lock releasing means 200, the transforming toy 100*g* transforms into a second form from the first form to allow the item 300 accommodated therein to be released from the fixed state so that the item 300 is discharged to the outside.

The transforming toy 100*g* according to the eighth embodiment of the present invention has the locking part 160*g* and the magnet 170*g* differently configured from those of the transforming toy 100 according to the first embodiment of the present invention.

The locking part 160*g* protrudes downwardly by a given length from the upper housing 110 and is changed to a lock releasing position through the physical contact with the lock releasing means 200 to allow the upper housing 110 to be separated from the lower housing 120 and thus transform into the second form. The locking part 160*g* includes a locking part body 161*g*, locking part rotary shafts 162*g*, link members 163*g*, a slide member 164*g*, coupling holes 165*g*, and a spring 166*g*.

The locking part body 161*g* is a bar-shaped member that rotates around the locking part rotary shafts 162*g* to allow the slide member 164*g* connected thereto by means of the link members 163*g* to move horizontally if a physical contact with the lock releasing means 200 occurs.

Further, one side end portion of the locking part body 161*g* passes through the through hole 128' formed on the auxiliary housing 128 of the lower housing 120, and the locking part body 161*g* includes a slant surface 161*g*' formed on one side end portion thereof in such a manner as to come into contact with the lock releasing means 200, so that the contact with the lock releasing means 200 is easily carried out.

The locking part rotary shafts 162*g* protrude by given length from both sides of the locking part body 161*g* in such a manner as to be rotatably coupled to the coupling holes 129" of the guides 129 located on the auxiliary housing 128 of the lower housing 120 to allow the locking part body 161*g* to rotate.

The link members 163*g* protrude by given length from both sides of the other side end portion of the locking part body 161*g* in such a manner as to be rotatably coupled to the slide member 164*g*.

The slide member 164*g* is connected to the link members 163*g* of the locking part body 161*g* by means of the coupling holes 165*g* and moves horizontally in a right or left direction in accordance with the forward or reverse rotation direction of the locking part body 161*g* to release the locked state thereof, so that the upper housing 110 transforms into the first form or the second form.

The spring 166*g* provides an elastic force to allow the slide member 164*g* to be maintained to the locked state at a given position, and if the slide member 164*g* moves horizontally to a given position and is thus released from the locked state thereof, the spring 166*g* provides an elastic force to allow the slide member 164*g* to be returned to its original position.

The magnet 170*g* is fixedly located to the auxiliary housing 128 to form a magnetic field together with the lock releasing means 200 physically contacted therewith, so that through the magnetic field, the lock releasing means 200 is attached to the underside of the upper housing 110.

Next, an explanation on the operation process of the transforming toy 100*g* according to the eighth embodiment of the present invention will be given.

If the transforming toy 100*g* is driven to allow the lock releasing means 200 located at a given position to be disposed thereunder, the front side and top surface of the lock releasing means 200 are physically contacted with the locking part 160*g* protruding by the given length from the underside of the transforming toy 100*g*.

Through the physical contact, if the locking part 160*g* rotates toward the rear side with respect to the direction where the transforming toy 100*g* is driven, the slide member 164*g* connected to the locking part body 161*g* by means of the link members 163*g* moves horizontally to the left direction on the drawing and is thus separated from the locking slot 122, so that the slide member 164*g* is released from the locked state thereof.

The first housing 110' of the upper housing 110 rotates around the rotary shafts 113 by means of the elastic forces of the springs 114 in a clockwise direction on the drawing, so that the upper housing 110 transforms into the second form from the first form.

If the first housing 110' rotates upwardly and is thus open, the lever 116 pressurizes the first latch 141' of the latch part 140, while rotating around the rotary shafts 113, thereby allowing the latch part 140 to be operated.

If the second latch 141" is released from the locked state by means of the operation of the latch part 140, the throwing part 130 rotates around the rotary shaft 126 by means of the elastic force of the spring 127, and if the rotation of the throwing part 130 is finished within a given range, the item 300 accommodated in the throwing part 130 is thrown forwardly by means of an inertial force.

On the other hand, the magnet 170*g* forms a magnetic field together with the magnetic material located inside the lock releasing means 200 to generate mutual attraction therewith, thereby allowing the lock releasing means 200 to be attached to the underside of the upper housing 110.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

In the description, the thicknesses of the lines or the sizes of the components shown in the drawing may be magnified for the clarity and convenience of the description. Further, the terms as will be discussed later are defined in accordance with the functions of the present invention, but may be varied under the intention or regulation of a user or operator. Therefore, they should be defined on the basis of the whole scope of the present invention.

*Explanations on Reference Numerals*

| | |
|---|---|
| 100: transforming toy | 110: housing |
| 110': first housing | 110": second housing |
| 111': first accommodation portion | |
| 111": second accommodation portion | |
| 112': first housing hinge | |
| 112": second housing hinge | |
| 113: rotary shaft | 114: spring |
| 115: through hole | 116: lever |
| 117: housing coupling hole | 118: auxiliary lever |
| 120: lower housing | 121: lower housing body |
| 122: locking slot | 123: first support stand |
| 124: support stand hinge | 125: second support stand |
| 126: rotary shaft | 127: spring |
| 128: auxiliary housing | 129: guide |
| 129': guide through hole | 130: throwing part |
| 131: throwing part hinge | 132: throwing part coupling hole |

-continued

| *Explanations on Reference Numerals* | |
|---|---|
| 140: latch part | 141: latch part body |
| 141': first latch | 141": second latch |
| 142: rotary shaft | 143: nut |
| 144: spring | 150: returning means |
| 160: locking part | 161: locking part body |
| 161': locking part protrusion | 162: locking part slant surface |
| 163: slide member | 163': slide member latch |
| 164: slide member slant surface | 165: magnet |
| 166: spring | 200: lock releasing means |
| 300: item | 310: item body |
| 311: first item hinge | 320: item head |
| 330: first item wing | 330a: item locking protrusion |
| 331: second item hinge | 331a: spring |
| 332: third item hinge | 340: second item wing |
| 350: item leg | 351: fourth item hinge |
| 360: item tail | 361: fifth item hinge |
| 370: item locking part | |
| 370a: item locking part locking protrusion | |
| 371: spring | |

The invention claimed is:

1. A transforming toy having a locking part adapted to maintain a first form of the transforming toy in a locked state to allow an item accommodated in the transforming toy to be fixed to the transforming toy, wherein when the locking part is released from the locked state through an attachment to a lock releasing means, the transforming toy transforms into a second form from the first form to allow the item accommodated in the transforming toy to be released from the fixed state, so that the item is discharged, the transforming toy comprising:

an upper housing having a plurality of housings foldable to each other so as to have accommodation spaces formed at an inside of the upper housing, and adapted to maintain either one of the first form and the second form;

a lower housing located under the upper housing to supportingly maintain the upper housing in the first form;

a throwing part rotatably coupled to the lower housing by means of a support stand hinge and a rotary shaft, and configured to pressurize the item by means of a spring mounted on the rotary shaft to throw the item;

a latch part located on the lower housing so as to allow the throwing part to be rotated and released from the locked state when the upper housing transforms into the second form; and the locking part, which is located in the upper housing so as to be changed to a lock releasing position by means of a magnetic force together with the lock releasing means, so that the upper housing is separated from the lower housing and transforms into the second form.

2. The transforming toy according to claim 1, wherein the transforming toy has a form of any one of an electrically movable car, a character, an object, an animal, and a doll.

3. A transforming toy having a locking part adapted to maintain a first form of the transforming toy in a locked state to allow an item accommodated in the transforming toy to be fixed to the transforming toy, wherein when the locking part is released from the locked state through an attachment to a lock releasing means, the transforming toy transforms into a second form from the first form to allow the item accommodated in the transforming toy to be released from the fixed state, so that the item is discharged, the transforming toy comprising:

an upper housing having a plurality of housings foldable to each other so as to have accommodation spaces formed at an inside of the upper housing, and adapted to maintain either one of the first form and the second form;

a lower housing located under the upper housing to supportingly maintain the upper housing in the first form;

a throwing part rotatably coupled to the lower housing by means of a support stand hinge and a rotary shaft, and configured to pressurize the item by means of a spring mounted on the rotary shaft to throw the item;

a latch part located on the lower housing so as to allow the throwing part to be rotated and released from the locked state when the upper housing transforms into the second form; and the locking part, which is located in the upper housing so as to be changed to a lock releasing position by means of physical contact with the lock releasing means so that the upper housing is separated from the lower housing and transforming toy transforms into the second form.

4. The transforming toy according to claim 3, further comprising a magnet adapted to form a magnetic field together with the lock releasing means so as to allow the lock releasing means to be attached to an underside of the upper housing.

5. A transforming toy having a locking part adapted to maintain a first form of the transforming toy in a locked state to allow an item accommodated in the transforming toy to be fixed to the transforming toy, wherein when the locking part is released from a locked state through an attachment to a lock releasing means, the transforming toy transforms into a second form from the first form to allow the item accommodated in the transforming toy to be released from the fixed state, so that the item is discharged, the transforming toy comprising:

an upper housing having an accommodation space formed at an inside of the upper housing;

a lower housing located under the upper housing to form an accommodation space in which the item is accommodated;

a pressurizing part adapted to cover the accommodation space of the lower housing so as to be rotatably coupled to a lower portion of the lower housing through a rotary shaft, and pressurize a floor through elastic forces of springs so as to allow the upper housing and the lower housing when the transforming toy transforms into the second form from the first form;

a first locking part located on a side of the lower housing so as to be movable in accordance with rotation positions of the pressurizing part to allow a discharging part to be locked or released from the locked state;

a second locking part located on the lower housing so as to fix the pressurizing part to the lower housing, and configured to be changed to a lock releasing position through either one or both of a magnetic force and physical contact with the lock releasing means to allow the pressuring part to rotate; and the discharging part, which is disposed in the accommodation space of the lower housing so as to be released from the locked state onto the first locking part to discharge the item when the upper housing and the lower housing are turned over when the transforming toy transforms into the second form by means of the pressurizing part.

6. The transforming toy according to claim 5, wherein the second locking part comprises:

a second locking part body configured to move upwardly and downwardly;

a slide member locked onto the second locking part body so as to move horizontally in accordance with upward and downward movements of the second locking part body;

second locking part slant portions formed on both side walls of the second locking part body so as to be locked onto the slide member to move the slide member horizontally;

slide member slant portions protruding upwardly from one side of the slide member so as to be locked onto the second locking part slant portions;

a slide member latch extended by a given length from the another side of the slide member slant portions to allow the pressurizing part to be locked or released from the locked state;

a spring adapted to provide an elastic force so that the slide member is maintained at a given position on a side of the second locking part body; and a magnet located on an underside of the second locking part body so as to allow the second locking part body to move downwardly and be attached to the item.

7. A transforming toy having a locking part adapted to maintain a first form of the transforming toy in a locked state to allow an item accommodated in the transforming toy to be fixed to the transforming toy, wherein when the locking part is released from a locked state through an attachment to a lock releasing means, the transforming toy transforms into a second form from the first form to allow the item accommodated in the transforming toy to be released from the fixed state, so that the item is discharged, the transforming toy comprising:

an upper housing having an accommodation space formed at an inside of the upper housing;

a plurality of fenders rotatably disposed horizontally on both sides of the upper housing so as to be separated from the upper housing to allow a pressurizing part to be operated when a second locking part is operated and released from the locked state;

a lower housing located under the upper housing to form an accommodation space in which the item is accommodated;

the pressurizing part, which is adapted to cover the accommodation space of the lower housing so as to be rotatably coupled to a lower portion of the lower housing through a rotary shaft and pressurize a floor through the elastic forces of springs so as to allow the upper housing and the lower housing to move when the transforming toy transforms into the second form from the first form;

a first locking part located on a side of the lower housing so as to be movable in accordance with rotation positions of the pressurizing part to allow a discharging part to be locked or released from the locked state;

a second locking part located on the lower housing so as to fix the pressurizing part to the lower housing, and configured to be changed to a lock releasing position by means of either one or both of a magnetic force and physical contact with the lock releasing means to allow the pressuring part to rotate; and the discharging part, which is disposed in the accommodation space of the lower housing so as to be released from the locked state onto the first locking part to discharge the item when the upper housing and the lower housing are turned over and the transforming toy transforms into the second form by means of the pressurizing part.

8. The transforming toy according to claim 7, wherein the second locking part comprises:

a second locking part body movable upwardly and downwardly, and having a second locking part latch disposed on top of the second locking body part so as to be locked onto the plurality of fenders to allow the plurality of fenders to be fixed to both sides of the upper housing;

a second locking part spring located between the second locking part body and the lower housing to provide an elastic force to allow the second locking part body to be maintained at a position; and a magnet located on an underside of the second locking part body so to allow the second locking part body to be attached to the item and move downwardly.

9. A transforming toy having a locking part adapted to maintain a first form of the transforming toy in a locked state to allow an item accommodated in the transforming toy to be fixed to the transforming toy, wherein when the locking part is released from a locked state through an attachment to a lock releasing means, the transforming toy transforms into a second form from the first form to allow the item accommodated in the transforming toy to be released from the fixed state, so that the item is discharged, the transforming toy comprising:

a housing having an accommodation space formed at an inside of the housing;

a pressurizing part rotatably coupled to a lower portion of the housing through a housing hinge and a first rotary shaft, and configured to pressurize a floor through an elastic force of a first spring mounted on the first rotary shaft to allow the housing to move when the transforming toy transforms into the second form from the first form;

a throwing part rotatably coupled to a side of the pressurizing part by means of a second pressurizing part hinge and a second rotary shaft so as to pressurize the item by means of the elastic force of a second spring mounted on the second rotary shaft and throw the item outside of the housing; and the locking part, which is located on the housing, and configured to be changed to a lock releasing position through by means of either one or both of a magnetic force and physical contact with the lock releasing means to allow the pressuring part to rotate.

10. The transforming toy according to claim 9, wherein the housing further comprises a housing latch protruding from the housing hinge so as to pressurize a side surface of the throwing part to allow the throwing part to rotate after a period of time passes.

11. The transforming toy according to claim 9, wherein the pressurizing part further comprises a pair of item supports adapted to come into contact with both sides of the item so as to fix the item to the pair of item supports.

12. The transforming toy according to claim 9, wherein the pressurizing part further comprises a protrusion extending from a top of the pressurizing part.

13. The transforming toy according to claim 9, wherein the throwing part further comprises any one of a magnetic material, a through hole, and a protrusion.

14. The transforming toy according to claim 9, wherein the locking part comprises:

a locking part body;

locking part slant surfaces formed on both side walls of the locking part body;

a slide member having slide member slant surfaces locked onto the locking part slant surfaces, and adapted to be changed in position to allow the pressurizing part to be locked or released from the locked state in accordance with upward and downward movements of the locking part body;

a magnet located on the locking part body so as to form a magnetic field together with the lock releasing means to provide a driving force so that the locking part body moves; and a spring adapted to provide an elastic force so as to allow the slide member to be maintained at a position.

15. The transforming toy according to any one of claims 1, 2, 3 and 4, further comprising a returning means connected between the upper housing and the throwing part so as to pullingly return the throwing part to an original position when the upper housing is returned to the first form from the second form.

16. The transforming toy according to claim 15, further comprising an auxiliary lever disposed at an inside of the upper housing so as to allow a portion of the upper housing to pressurize an upper portion of the throwing part and return the throwing part to an original position.

17. The transforming toy according to any one of claims 1, 3, 5, 7 and 9, wherein the item is a member or a card having any one of an animal, an object, a doll, and a character.

18. The transforming toy according to claim 17, wherein the item comprises:

an item body;

a plurality of rotary members foldably disposed on the item body by means of a plurality of item hinges;

a plurality of fourth springs adapted to provide elastic forces to allow the rotary members to be unfoldable around the plurality of item hinges; and an item locking part configured to be changed in position to allow the item to be maintained in any one of the first form in which the item is folded and the second form in which the item is unfolded.

19. The transforming toy according to claim 17, wherein the item further comprises a magnet.

20. The transforming toy according to claim 17, wherein the item comprises:

an item body;

a plurality of rotary members foldably disposed on the item body by means of a plurality of hinges;

a plurality of fourth springs adapted to provide elastic forces to allow the rotary members to be unfoldable around the plurality of item hinges; and coupling holes formed in the plurality of rotary members and having a concentric axis with each other.

21. The transforming toy according to any one of claims 1, 3, 5, 7 and 9, wherein the lock releasing means has a magnetic material disposed in an interior of the lock releasing means.

* * * * *